US011208899B2

(12) United States Patent
Dyson et al.

(10) Patent No.: US 11,208,899 B2
(45) Date of Patent: Dec. 28, 2021

(54) COOLING ASSEMBLY FOR A TURBINE ASSEMBLY

(71) Applicant: General Electric Company, Schenectady, NY (US)

(72) Inventors: Thomas Earl Dyson, Niskayuna, NY (US); Nicholas William Rathay, Rock City Falls, NY (US); Gustavo Ledezma, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 16/325,196

(22) PCT Filed: Mar. 14, 2018

(86) PCT No.: PCT/US2018/022307
§ 371 (c)(1),
(2) Date: Feb. 13, 2019

(87) PCT Pub. No.: WO2019/177598
PCT Pub. Date: Sep. 19, 2019

(65) Prior Publication Data

US 2021/0332707 A1 Oct. 28, 2021

(51) Int. Cl.
*F01D 5/18* (2006.01)

(52) U.S. Cl.
CPC ..... *F01D 5/186* (2013.01); *F05D 2220/32* (2013.01); *F05D 2240/30* (2013.01); *F05D 2260/201* (2013.01); *F05D 2260/202* (2013.01)

(58) Field of Classification Search
CPC ... F01D 5/12; F01D 5/14; F01D 5/147; F01D 5/18; F01D 5/186; F01D 5/187;
(Continued)

(56) References Cited

U.S. PATENT DOCUMENTS 2,919,549 A * 1/1960 Haworth ..... F02K 1/822 60/753
6,164,914 A * 12/2000 Correia ..... F01D 5/187 416/97 R (Continued)

FOREIGN PATENT DOCUMENTS

| | | |
|---|---|---|
| EP | 1557533 B1 | 3/2008 |
| EP | 3159481 A1 | 4/2017 |
| WO | 2019177598 A1 | 9/2019 |

OTHER PUBLICATIONS

International Preliminary Report on Patentability dated Sep. 24, 2020 for corresponding application No. PCT/US2018/022307.

(Continued)

*Primary Examiner* — Christopher Verdier
*Assistant Examiner* — Elton K Wong
(74) *Attorney, Agent, or Firm* — Charlotte Wilson; Hoffman Warnick LLC

(57) ABSTRACT

A cooling assembly comprises a pin disposed inside a first chamber of an airfoil. The first chamber is disposed inside the tip end comprising a tip floor. The pin extends from a first end to a second end along a pin axis. The first end is coupled with a first surface of the first chamber and the second end is coupled with an inner floor surface of the tip floor such that the pin increases a structural load support level of the tip floor. A cooling conduit is placed inside the pin through which coolant flows. The cooling conduit is elongated along and extends around a conduit axis and is fluidly coupled with conduit channels disposed between the first and second ends of the pin. The conduit channels direct coolant out of the cooling conduit or direct coolant into the cooling conduit.

20 Claims, 13 Drawing Sheets

(58) Field of Classification Search
CPC .... F01D 25/08; F01D 25/12; F05D 2260/201; F05D 2260/202; F05D 2260/22141; F05D 2240/30; F05D 2240/307; F05D 2220/32
See application file for complete search history.

(56) References Cited

U.S. PATENT DOCUMENTS

| | | | | |
|---|---|---|---|---|
| 6,932,571 | B2 | 8/2005 | Cunha et al. | |
| 7,837,440 | B2 | 11/2010 | Bunker et al. | |
| 8,079,811 | B1 | 12/2011 | Liang | |
| 8,109,726 | B2 | 2/2012 | Liang | |
| 8,262,357 | B2 | 9/2012 | Mhetras | |
| 9,188,012 | B2 | 11/2015 | Lacy et al. | |
| 9,249,670 | B2 | 2/2016 | Bunker | |
| 9,297,262 | B2 | 3/2016 | Zhang et al. | |
| 9,713,843 | B2 | 7/2017 | Snyder et al. | |
| 2009/0180895 | A1* | 7/2009 | Brittingham | F01D 5/225 416/97 R |
| 2014/0083116 | A1* | 3/2014 | Crites | F01D 5/187 60/806 |
| 2016/0208705 | A1 | 7/2016 | Slavens et al. | |

OTHER PUBLICATIONS

Lambie et al., "An Overview on Micro-Meso Manufacturing Techniques for Micro-Heat Exchangers for Turbine Blade Cooling", International Journal of Manufacturing Research, vol. 03, Issue: 01, pp. 1-26, Jan. 2008.

Wang et al., "Influence of Different Rim Widths and Blowing Ratios on Film Cooling Characteristics for a Blade Tip", Journal of Heat Transfer, vol. 134, Issue: 06, pp. 08, May 8, 2012.

Xie et al., "Experimental and Numerical Investigation of Heat Transfer and Friction Performance for Turbine Blade Tip Cap with Combined Pin-Fin-Dimple/Protrusion Structure", International Journal of Heat and Mass Transfer, vol. 104, pp. 1120-1134, Jan. 2017.

International Search Report issued in connection with corresponding PCT application No. PCT/US2018/022307 dated Oct. 30, 2018.

* cited by examiner

COOLING ASSEMBLY FOR A TURBINE ASSEMBLY

FIELD

The subject matter described herein relates to cooling assemblies for equipment such as turbine airfoils.

BACKGROUND

The turbine assembly can be subjected to increased heat loads when an engine is operating. To protect the turbine assembly components from damage, cooling fluid may be directed in and/or out of the turbine assembly. Component temperatures can be managed through a combination of impingement cooling, cooling flow through passages in the components, and film cooling with the goal of balancing component life and turbine efficiency. Improved efficiency can be achieved through increasing firing temperatures reducing the volume of cooling flow, or a combination.

Known turbine assemblies are often formed by assembling additively manufactured components. In particular, additively manufactured tips of airfoils can require additional support structures in order to achieve a desired final shape of the airfoil as well as support the tip floor when the engine is operating. The support structures can be difficult, and often times impossible, to access or remove from internal cavities of the turbine assembly. Additionally, the tip end of the turbine blade is subjected to high heat loads, making the tip end of the airfoil one of the hottest regions of the turbine blade.

BRIEF DESCRIPTION

In one embodiment, a cooling assembly comprises a pin disposed inside a first chamber of an airfoil that extends from a hub end to a tip end along a radial length of the airfoil. The first chamber of the airfoil is disposed inside the tip end of the airfoil. The tip end of the airfoil comprises a tip floor. The pin extends from a first end to a second end along a pin axis. The first end of the pin is configured to be operably coupled with a first surface of the first chamber in the airfoil and the second end of the pin is configured to be operably coupled with an inner floor surface of the tip floor such that the pin increases a structural load support level of the tip floor relative to the first end of the pin not being operably coupled with the first surface of the first chamber and the second end of the pin not being operably coupled with the inner floor surface of the tip floor. The cooling assembly also comprises a cooling conduit configured to be placed inside the pin through which coolant flows. The cooling conduit is elongated along and extends around a conduit axis. The cooling conduit is fluidly coupled with one or more conduit channels disposed between the first end of the pin and the second end of the pin. The one or more conduit channels are configured to direct the coolant out of the cooling conduit or direct the coolant into the cooling conduit.

In one embodiment, a cooling assembly comprises a pin disposed inside a first chamber of an airfoil that extends from a hub end to a tip end along a radial length of the airfoil. The first chamber of the airfoil is disposed inside the tip end of the airfoil. The tip end of the airfoil comprises a tip floor. The pin extends from a first end to a second end along a pin axis. The first end of the pin is configured to be operably coupled with a first surface of the first chamber in the airfoil and the second end of the pin is configured to be operably coupled with an inner floor surface of the tip floor such that the pin increases a structural load support level of the tip floor relative to the first end of the pin not being operably coupled with the first surface of the first chamber and the second end of the pin not being operably coupled with the inner floor surface of the tip floor. The cooling assembly also comprises a cooling conduit configured to be placed inside the pin through which coolant flows. The cooling conduit is elongated along and extends around a conduit axis. The cooling conduit is fluidly coupled with one or more conduit channels disposed between the first end of the pin and the second end of the pin. The one or more conduit channels are configured to direct the coolant out of the cooling conduit or direct the coolant into the cooling conduit. The cooling assembly also comprises a second chamber disposed inside the airfoil. The second chamber is fluidly coupled with the cooling conduit. The cooling conduit is configured to direct the coolant from the second chamber to the first chamber.

In one embodiment, a cooling assembly comprises plural pins disposed inside a first chamber of a component of a turbine assembly that extends from a hub end to a tip end along a radial length. The tip end comprises a tip floor. Each pin extends from a first end to a second end along a pin axis of each pin. The first end of each pin is configured to be operably coupled with a first surface of the first chamber and the second end of each pin is configured to be operably coupled with an inner floor surface of the tip floor such that the pins increase a structural load support level of the tip floor relative to the first ends of the pins not being operably coupled with the first surface of the first chamber and the second ends of the pins not being operably coupled with the inner floor surface of the tip floor. The cooling assembly also comprising a cooling conduit configured to be places inside each pin through which coolant flows. Each cooling conduit is elongated and extends around a conduit axis. The cooling conduits are fluidly coupled with one or more conduit channels disposed between the first end of the pin and the second end of the pin. The one or more conduit channels are configured to direct the coolant out of the cooling conduit or direct the coolant into the cooling conduit.

BRIEF DESCRIPTION OF THE DRAWINGS

The present inventive subject matter will be better understood from reading the following description of non-limiting embodiments, with reference to the attached drawings, wherein below.

DETAILED DESCRIPTION

One or more embodiments of the inventive subject matter described herein relate to systems and methods that effectively cool a tip end of a turbine airfoil and effectively support the tip end of the turbine airfoil. The tip end of the airfoil is subjected to high heat loads and is difficult to effectively cool. Additionally, additively manufactured tip ends may require support for the tip floor for production of the turbine assembly.

To address these problems, one embodiment of the inventive systems and methods includes pins disposed inside a first chamber of air airfoil at the tip end of the airfoil. The pins are operably coupled with a first surface of the first chamber and an inner tip floor surface of the tip floor. The pins improve a structural support level of the tip floor relative to the pins not being operably coupled with the two surfaces. Additionally, a cooling conduit is disposed inside each pin inside the first chamber of the cooling assembly. The cooling conduit fluidly couples a second chamber disposed inside the airfoil with the first chamber in order to direct coolant out of the second chamber and into the first chamber. The cooling conduit may also direct coolant from the second chamber to the inner floor surface of the tip floor in order to improve the cooling of the tip floor. At least one technical effect of the subject matter described herein includes increasing a structural support level of a tip floor and increase a potential of heat transfer inside the airfoil. Another technical effect of the subject matter described herein includes improved cooling that may reduce airfoil temperatures and therefore extend part life and reduce unplanned outages.

Figure 1:
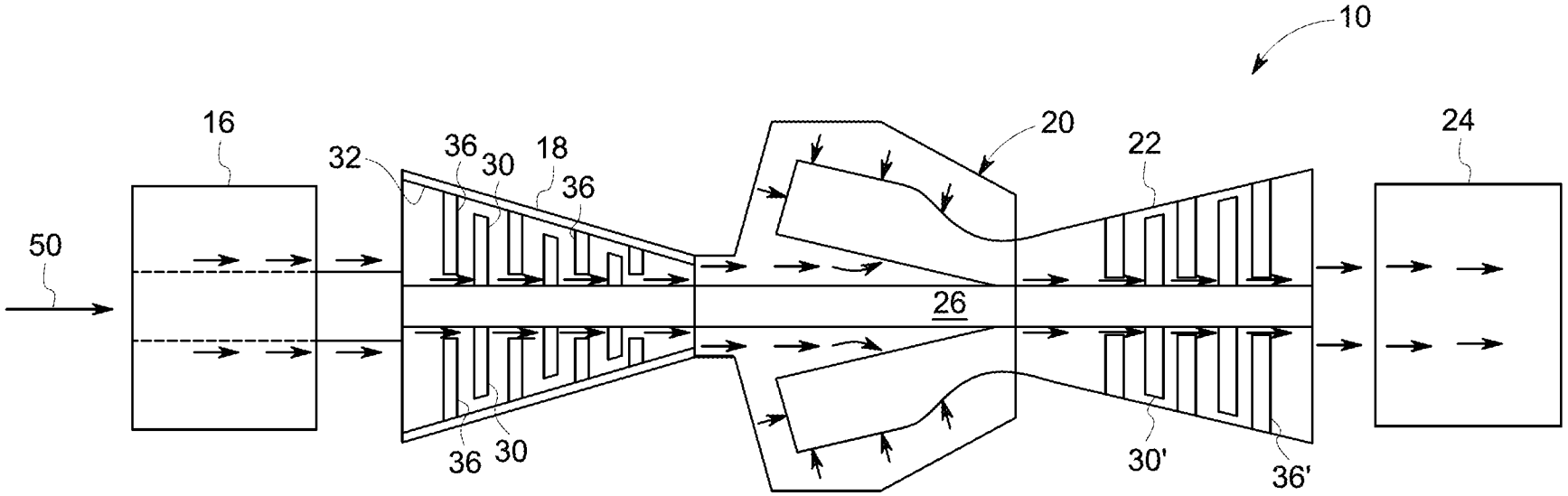
FIG. 1 illustrates a cross-sectional partial side view of a gas turbine engine in accordance with one embodiment.

FIG. 1 illustrates a turbine assembly 10 in accordance with one embodiment. The turbine assembly 10 includes an inlet 16 through which air enters the turbine assembly 10 in the direction of arrow 50. The air travels in a direction 50 from the inlet 16, through a compressor 18, through a combustor 20, and through a turbine 22 to an exhaust 24. A rotating shaft 26 runs through and is coupled with one or more rotating components of the turbine assembly 10.

The compressor 18 and the turbine 22 comprise multiple airfoils. The airfoils may be one or more of blades 30, 30' or guide vanes 36, 36'. The blades 30, 30' are axially offset from the guide vanes 36, 36' in the direction 50. The guide vanes 36, 36' are stationary components. The blades 30, 30' are operably coupled with and rotate with the shaft 26.

Figure 2:
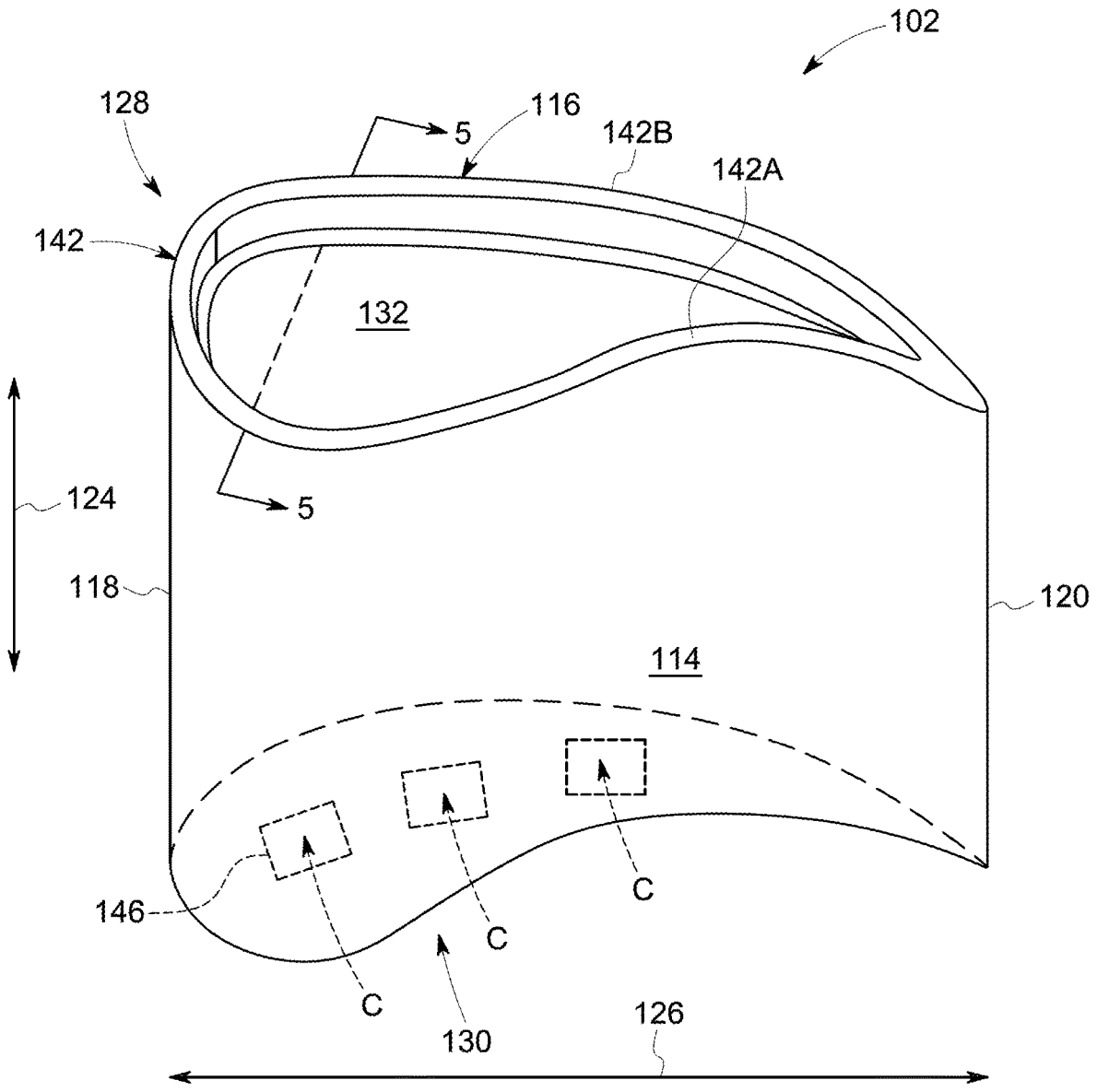
FIG. 2 illustrates a perspective view of an airfoil in accordance with one embodiment.

FIG. 2 illustrates a perspective view of an airfoil 102 of the turbine assembly 10 of FIG. 1 in accordance with one embodiment. The airfoil 102 may be a turbine blade used in the turbine assembly 10. The airfoil 102 has a pressure side 114 and a suction side 116 that is opposite the pressure side 114. The pressure side 114 and the suction side 116 are interconnected by a leading edge 118 and a trailing edge 120 that is opposite the leading edge 118. The pressure side 114 is generally concave in shape, and the suction side 116 is generally convex in shape between the leading and trailing edges 118, 120. For example, the generally concave pressure side 114 and the generally convex suction side 116 provides an aerodynamic surface over which compressed working fluid flows through the turbine assembly 10.

The airfoil 102 extends an axial length 126 between the leading edge 118 and the trailing edge 120. Optionally, the axial length 126 may be referred to as a chordwise length between the leading and trailing edges 118, 120. The airfoil 102 extends a radial length 124 between a tip end 128 and a hub end 130. For example, the axial length 126 is generally perpendicular to the radial length 124. In one or more embodiments, the hub end 130 may be operably coupled with the rotating shaft 26 of the turbine assembly 10, and the airfoil 102 extends a distance away from the rotating shaft 26 along the radial length 124 of the airfoil 102.

In the illustrated embodiment, the tip end 128 of the airfoil 102 has a tip rail 142. The tip rail 142 is a blade tip rail commonly referred to as a squealer tip. The tip rail 142 includes a pressure side tip rail 142A and a suction side tip rail 142B, respectively positioned on the pressure and suction sides 114, 116 of the airfoil 102. For example, the pressure side tip rail 142A may extend along the perimeter of the pressure side 114 between the leading edge 118 and the trailing edge 120 of the airfoil 102, and the suction side tip rail 142B may extend along the perimeter of the suction side 116 between the leading edge 118 and the trailing edge 120 of the airfoil 102. Optionally, the tip rail 142 may extend along the perimeter of only one of the pressure side 114 or suction side 116. Optionally, the tip rail 142 may extend along the pressure and suction sides 114, 116, with one or more tip rails extending between the pressure and suction sides 114, 116 and between the leading edge 118 and the trailing edge 120. Optionally, the airfoil 102 may not include a tip rail 142 at the tip end 128 of the airfoil 102.

The airfoil 102 has a tip floor 132 near the tip end 128 that extends between the pressure side 114 and the suction side 116 of the airfoil 102. The pressure side rail 142A extends radially outwardly from an outer floor surface of the tip floor 132 and extends between the leading edge 118 and the trailing edge 120 along the axial length 126 of the airfoil 102. For example, the pressure side tip rail 142A extends a distance away from the tip floor 132 along the radial length 124 of the airfoil 102. The path of the pressure side tip rail 142A is adjacent to or near the outer radial edge of the pressure side 114 such that the pressure side tip rail 142A aligns with the outer radial edge of the pressure side 114. The suction side tip rail 142B extends radially outward from the tip floor 132 and extends between the leading edge 118 and the trailing edge 120 along the axial length 126 of the airfoil 102. For example, the suction side tip rail 142B extends a distance away from the tip floor 132 along the radial length 124 of the airfoil 102. The path of the suction side tip rail 142B is adjacent to or near the outer radial edge of the suction side 116 of the airfoil 102 such that the suction side tip rail 142B aligns with the outer radial edge of the suction side 116. Optionally, the pressure side tip rail 142A and/or the suction side tip rail 142B may follow an alternative profile between the leading edge 118 and the trailing edge 120 along the axial length 126 of the airfoil 102. For example, the pressure side tip rail 142A and/or the suction side tip rail 142B may be moved a distance away from the outer radial edge of the pressure or suction sides 114, 116, respectively.

In one or more embodiments, the airfoil 102 may include a plurality of exhaust holes (not shown) at any location along the axial and/or radial lengths 126, 124 of the airfoil 102. For example, the airfoil 102 may include a plurality of rail exhaust holes disposed on a top, inside, and/or outside surface of the tip rail 142, a plurality of body exhaust holes disposed on the pressure side 114 and/or suction side 116 of the airfoil 102, or any combination therein. The rail exhaust holes may be disposed at substantially equal (e.g., patterned) or non-equal (e.g., random) distances apart from each other along the tip rail 142 between the leading edge 118 and the trailing edge 120. Additionally, the body exhaust holes may also be disposed at substantially equal (e.g., patterned) or non-equal (e.g., random) distances apart from each other along the pressure side 114 and suction side 116 (not shown) between the leading edge 118 and the trailing edge 120. Optionally, the airfoil 102 may include any number of rail exhaust holes, body exhaust holes, or the like, that may be disposed at uniform or non-uniform distances apart from each other (e.g., in a patterned configuration, random configuration, a combination of patterned and random, or the like) along the radial length 124 and axial length 126 of the airfoil 102. Additionally or alternatively, the exhaust holes may have any common and/or unique shapes and/or sizes, or any combination therein.

The airfoil 102 includes at least one inlet passage 146 at the hub end 130 of the airfoil 102. In the illustrated embodiment, the airfoil 102 includes three inlet passages 146, however the airfoil 102 may include any number of passages 146. The inlet passages 146 may direct coolant C or a cooling fluid from a location outside of the airfoil 102 into the airfoil 102. For example, the coolant C may be directed into one or more chambers inside the airfoil 102 to manage the temperature of the airfoil 102 or to manage the temperature of one or more components, features, or surfaces of the airfoil 102.

Figure 3:
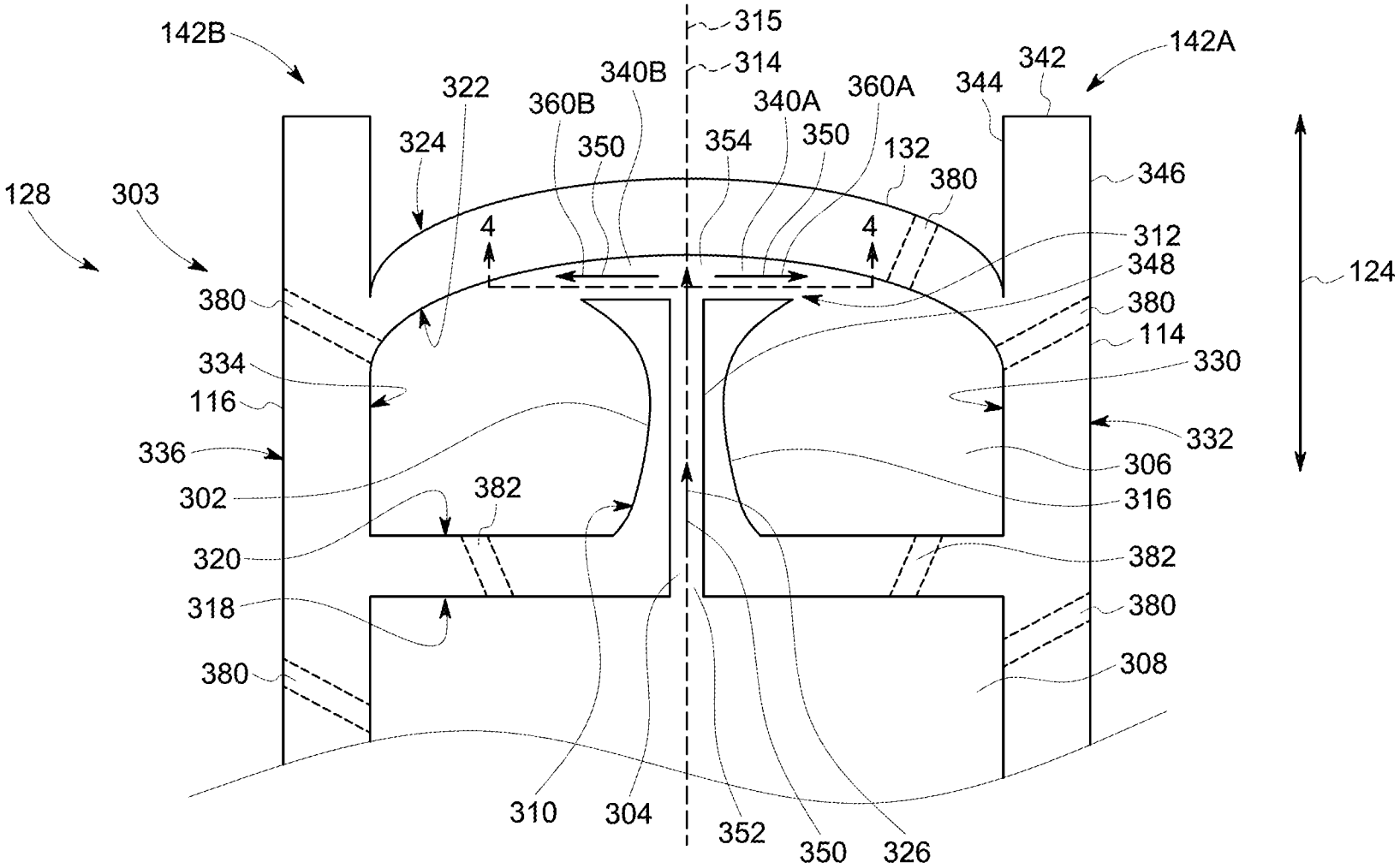
FIG. 3 illustrates a partial cross-sectional view of an airfoil in accordance with one embodiment.

FIG. 3 illustrates a partial cross-sectional view of the airfoil 102 in accordance with one embodiment. The airfoil 102 includes a cooling assembly 303 that is disposed inside the airfoil 102 at the tip end 128 of the airfoil 102 along the radial length 124 of the airfoil 102. The cooling assembly 303 includes a first cooling chamber 306 that is entirely contained within the airfoil 102. Additionally, the first cooling chamber 306 is entirely contained within the tip end 128 of the airfoil 102. The first cooling chamber 306 extends between a pressure side inner surface 330 and a suction side inner surface 334 in a span-wise direction, and extends between a first surface 320 and an inner floor surface 322 of the tip floor 132 in a direction along the radial length 124. Optionally, the first cooling chamber 306 may be separated or divided into plural first cooling chambers (not shown) that may have any shape and/or size inside the tip end 128 of the airfoil 102. For example, the first cooling chamber 306 may include plural complex cooling circuits having multiple features such as passages, channels, inlets, outlets, ribs, pin banks, circuits, sub-circuits, film holes, plenums, mesh, turbulators, or the like.

The cooling assembly 303 also includes a second cooling chamber 308 that is entire contained within the airfoil 102. The second cooling chamber 308 is disposed between the hub end 130 (of FIG. 2) and the first cooling chamber 306 along the radial length 124 of the airfoil 102. In the illustrated embodiment, the second cooling chamber 308 extends between the pressure side inner surface 330 and the suction side inner surface 334 in a span-wise direction. Optionally, the second cooling channel 308 may be separated or divided into plural second cooling chambers (not shown) that may have any shape and/or size inside the airfoil 102. For example, the second cooling chamber 308 may include plural complex cooling circuits having multiple features such as passages, channels, inlets, outlets, ribs, pin banks, circuits, sub-circuits, film holes, plenums, mesh, turbulators, or the like.

The second cooling chamber 308 is fluidly coupled with the one or more inlet passages 146 (of FIG. 2). The inlet passages 146 direct the coolant C from a location outside of the airfoil 102 into the second cooling chamber 308. For example, the coolant may be directed into the second cooling chamber 308 to cool the airfoil 102 and/or manage the temperature of the airfoil 102 or to manage the temperature of one or more components or features of the airfoil 102 of the turbine assembly 10. Optionally, one or more additionally chambers, channels, passages, or the like, may be disposed between the inlet passages 146 and the second cooling chamber 308. For example, the coolant C may be directed through plural different circuits, channels, chambers, passages, or the like, as the coolant C is directed from the inlet passages 146 to the second cooling chamber 308.

The cooling assembly 303 includes a pin 302 that is disposed inside the first cooling chamber 306 of the airfoil 102. The pin 302 extends between a first end 310 and a second end 312. The first end 310 of the pin 302 is operably coupled with the first surface 320 of the first chamber 306, and the second end 312 of the pin is operably coupled with the inner floor surface 322 of the tip floor 132 (illustrated in FIG. 4). For example, the first end 310 of the pin 302 may be integrated, formed, machined, printed, adhered, fixed, or the like, with the first surface 320. Additionally, the second end 312 of the pin 302 may be integrated, formed, machined, printed, adhered, fixed, or the like, with the inner floor surface 322 of the tip floor 132. The pin 302 increases a structural load support level of the tip floor 132 relative to the first and second ends 310, 312 not being operably coupled with the first surface 320 and the inner floor surface 322, respectively. For example, the pin 302 supports the tip floor 132 of the airfoil 102.

The pin 302 extends between the first end 310 and the second end 312 along a pin axis 314. In the illustrated embodiment, the pin axis 314 is substantially parallel to the radial length 124 of the airfoil 102. Additionally or alternatively, the pin axis 314 may extend in an alternative direction that is not parallel to the radial length 124. The pin 302 has an exterior surface 316 that extends circumferentially about the pin axis 314 and radially between the first and second ends 310, 312. In the illustrated embodiment, the exterior surface 316 of the pin 302 has an hour-glass shape along and about the pin axis 314. For example, the pin 302 has a center circumference at a radial position substantially centered between the first and second ends 310, 312 that is smaller than a first end circumference at a radial position proximate the first end 310, and that is smaller than a second end circumference at a radial position proximate the second end 312. Additionally, the first end circumference and the second end circumference are substantially uniform. Alternatively, the first end circumference may have a unique shape and/or size relative to the second end circumference. Optionally, the pin 302 may have any alternative uniform, unique, or the like, shape and/or size between the first end 310 and the second end 312 at different radial positions along the pin axis 314.

In the illustrated embodiment of FIG. 3, a single pin 302 is illustrated extending between the first surface 320 and the inner floor surface 322. Additionally or alternatively, the cooling assembly 303 may include any number of pins 302 disposed at any location inside the first chamber 306 with each pin 302 extending between the first surface 320 and the inner floor surface 322. Optionally, the cooling assembly 303 may include any number of pins 302 disposed at any alternative location inside the airfoil 102 and operably coupled with any two surfaces of the airfoil 102 such that the pins 302 may increase a structure load support level of any surface and/or component of the airfoil 102 relative to the first and second ends 310, 312 of each pin 302 not being operably coupled with two surfaces of the airfoil 102.

The cooling assembly 303 also includes a cooling conduit 304 that is disposed inside the pin 302. The cooling conduit 304 is elongated along and extends around a conduit axis 315. In the illustrated embodiment, the cooling conduit 304 is generally centered about the conduit axis 315 and the pin axis 314 between the first and second ends 310, 312 of the pin such that the pin axis 314 and the conduit axis 315 extend in substantially the same directions. Optionally, the cooling conduit 304 may be elongated along and extend around the conduit axis 315 and may not be generally centered about the pin axis 314. For example, the pin axis 314 and the conduit axis 315 may extend in different directions.

The cooling conduit 304 fluidly couples the second chamber 308 with the first chamber 306. The cooling conduit 304 may also be referred to herein as a channel, a microchannel, a passage, or the like. The cooling conduit 304 directs at least some coolant 350 out of the second chamber 308 and through the cooling conduit 304. For example, the cooling conduit 304 directs the coolant 350 to the inner floor surface 322 of the tip floor 132 in order to cool the inner floor surface 322 of the tip floor 132 when the turbine assembly is operating.

The cooling conduit 304 has an exterior surface 348 that extends circumferentially about the conduit axis 315 and radially between a first end 352 and a second end 354. In the illustrated embodiment, the exterior surface 348 of the conduit 304 has a tubular shape along the pin and conduit axis 314, 315. Additionally or alternatively, the conduit 304 may have any alternative shape and/or size between the first end 352 and the second end 354 inside the pin 302. For example, the conduit 304 may have a circular cross-sectional shape with a decreasing circumference from the first end 352 to the second end 354, with an increasing circumference from the first end 352 to the second end 354, with any non-uniform shape such as but not limited to round, quadrilateral, or the like, between the first and second ends 352, 354, or the like.

Figure 4:
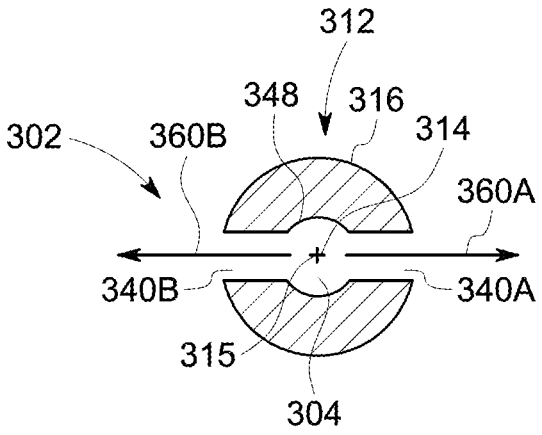
FIG. 4 illustrates a cross-sectional top view of a pin of the cooling assembly of FIG. 3 in accordance with one embodiment.

The first end 352 of the conduit 304 is disposed near the first surface 318 of the second chamber 308 and the second end 354 of the conduit 304 is disposed near the inner floor surface 322 of the tip floor 132 (illustrated in FIG. 4). For example, the conduit 304 is an open passage between the second chamber 308 at the first end 352 of the conduit 304 and the first chamber 306 at the second end 354 of the conduit 304 that directs the coolant 350 in a direction along the pin axis 314 from the second chamber 308 to the first chamber 306. Alternative configurations of the pin 302 and cooling conduit 304 will be described below.

In one or more embodiments, the cooling assembly 303 may include plural cooling conduits 304 disposed inside the pin 302. For example, the cooling assembly 303 may include two, five, ten, or the like, cooling conduits 304 inside the pin 302 that may have any common and/or unique shapes, sizes, orientations, or the like, between the first and second ends 310, 312 of the pin 302. In one embodiment, one or more cooling conduits 304 disposed inside the pin 302 may be fluidly coupled with each other cooling conduit 304 with one or more conduit channels. Optionally, each cooling conduit 304 may be fluidly separated from one or more other cooling conduit 304.

The cooling assembly 303 also includes one or more conduit channels 340 fluidly coupled with the cooling conduit 304. In the illustrated embodiment, the cooling assembly 303 includes a first conduit channel 340A and a second conduit channel 340B that has substantially the same shape and size as the first conduit channel 340A. For example, the first conduit channel 340A and the second conduit channel 340B are substantially mirrored about the pin axis 314. Optionally, the conduit channels 340 may have any alternative unique or common shape and/or size. In the illustrated embodiment, the first and second conduit channels 340A, 340B are elongated and extend in a direction that is substantially perpendicular to the pin axis 314. Optionally, one or more of the conduit channels 340 may extend in any radial direction away from the pin axis 314 in order to direct coolant out of the cooling conduit 304 and into the first chamber 306.

In the illustrated embodiment, the first and second exhaust channels 340A, 340B are disposed proximate the second end 312 of the pin 302. Optionally, one or more of the conduit channels 340 may be disposed at any radial location of the pin 302 along the radial length 124, each exhaust channel may be disposed at different radial locations of the pin 302 from each other exhaust channel along the radial length 124, or the like. The conduit channels 340A, 340B direct some of the coolant 350 out of the cooling conduit 304 and into the first chamber 306. For example, the conduit channels 340 direct some of the coolant 350 out of the conduit 304 and into the first chamber 306 in order to manage the temperature of one or more surfaces, components, features, or the like, disposed inside the first chamber 306.

The cooling conduit 304 directs the coolant 350 out of the second chamber 308 in a first direction 326 towards the inner floor surface 322. For example, the cooling conduit 304 directs the coolant 350 to impinge against the inner floor surface 322 at the second end 354 of the cooling conduit 304. Additionally, the conduit channels 340A, 340B direct some of the coolant 350 out of the conduit 304 and along directions 360A, 360B that are different than the first direction 326. In the illustrated embodiment, the exhaust channels 340A, 340B direct the coolant 350 in the directions 360A, 360B that are substantially perpendicular to the first direction 326. Optionally, the conduit channels 340 may direct some of the coolant 350 out of the cooling conduit 304 in any alternative direction relative to the first direction 326. Alternative confirmations of the cooling conduit 304 and the conduit channels 340 will be described below.

The flow of the coolant 350 through the cooling conduit 304 and exhausted through the conduit channels 340A, 340B create an amount of heat transfer at the turn at the inner floor surface 322, inside the cooling conduit 304, or the like, that is greater relative to a cooling assembly that does not include the cooling conduit 304 fluidly coupled with the conduit channels 340A, 340B. For example, the cooling assembly 303 may create an amount of heat transfer such that the coolant 350 that is directed out of the cooling conduit 304 may be reused for cooling the first chamber 306, the tip rail 142, one or more exterior surfaces of the airfoil, or the like.

In one or more embodiments, the airfoil 102 may include one or more exterior exhaust channels 380 and/or one or more interior channels 382. The exterior exhaust channels 380 may direct coolant out of the airfoil 102 along the pressure side 114, the suction side 116, the leading edge 118, the trailing edge 120, the tip floor 132, the rail top surface 342, the rail inner surface 344, or the rail outer surface 346 in any combination therein. For example, the exterior exhaust channels 380 may direct some coolant out of the airfoil 102 in order to manage the temperature of one or more exterior surfaces of the airfoil 102. Additionally, the interior channels 382 may direct coolant inside the airfoil 102 between the first chamber 306 and the second chamber 308, or between any two or more chambers disposed inside the airfoil 102. For example, the interior channels 382 may direct some coolant towards interior surfaces and/or chambers disposed inside the airfoil 102 in order to manage the temperature of one or more interior surfaces and/or areas of the airfoil 102.

FIG. 4 illustrates a cross-sectional top view of section B-B of FIG. 3 in accordance with one embodiment. The section B-B extends through the second end 312 of the pin 302 at a position proximate the inner floor surface 322 of the tip floor 132. The second end 312 of the pin 302 is operably coupled with the inner floor surface 322 of the tip floor 132. Additionally, the cooling conduit 304 and the conduit channels 340A, 340B are not operably coupled with the inner floor surface 322 of the tip floor 132. For example, the cooling conduit 304 is an open passage that directs coolant 350 to the inner floor surface 322, and the conduit channels 340A, 340B are open passages that direct some of the coolant out of the conduit 304 and into the first chamber 306.

In the illustrated embodiment, the exterior surface 348 of the conduit 304 and the exterior surface 316 of the pin 302 are substantially concentric about the pin axis 314. Additionally or alternatively, the exterior surfaces 348, 316 may have common cross-sectional shapes but may not be concentric about the pin axis 314, may have unique cross-sectional shapes, or any combination therein. For example, the exterior surface 348 of the conduit 304 may have an oval cross-sectional shape, and the exterior surface 316 of the pin may have an alternative cross-sectional shape (e.g., round, rectangular, quadrilateral, or the like).

The first conduit channel 340A directs some of the coolant 350 out of the conduit 304 in the direction 360A. The second conduit channel 340B directs some of the coolant 350 out of the conduit 304 in the direction 360B that is in a direction substantially parallel to and opposite from the direction 360A. Additionally or alternatively, the direction 360A may extend in a direction that is not substantially parallel to the direction 360B. For example, the first conduit channel 340A may be disposed at any angular position about the pin axis 314 and may direct the coolant in the direction 360A that may not be parallel to and/or opposite the direction 360B. Optionally, the cooling assembly 303 may include only the first conduit channel 340A and may not include the second conduit channel 340B. Optionally, the cooling assembly 303 may include any number of conduit channels 340 arranged in any configuration angularly about the pin axis 314, at any radial position along the radial length 124 of the pin 302 between the first end 310 and the second end 312 of the pin 302, or any combination therein. For example, the cooling assembly 303 may include any number of conduit channels 340 that may direct coolant into and/or out of the cooling conduit 304 in any common, opposite, or unique directions.

Figure 5:
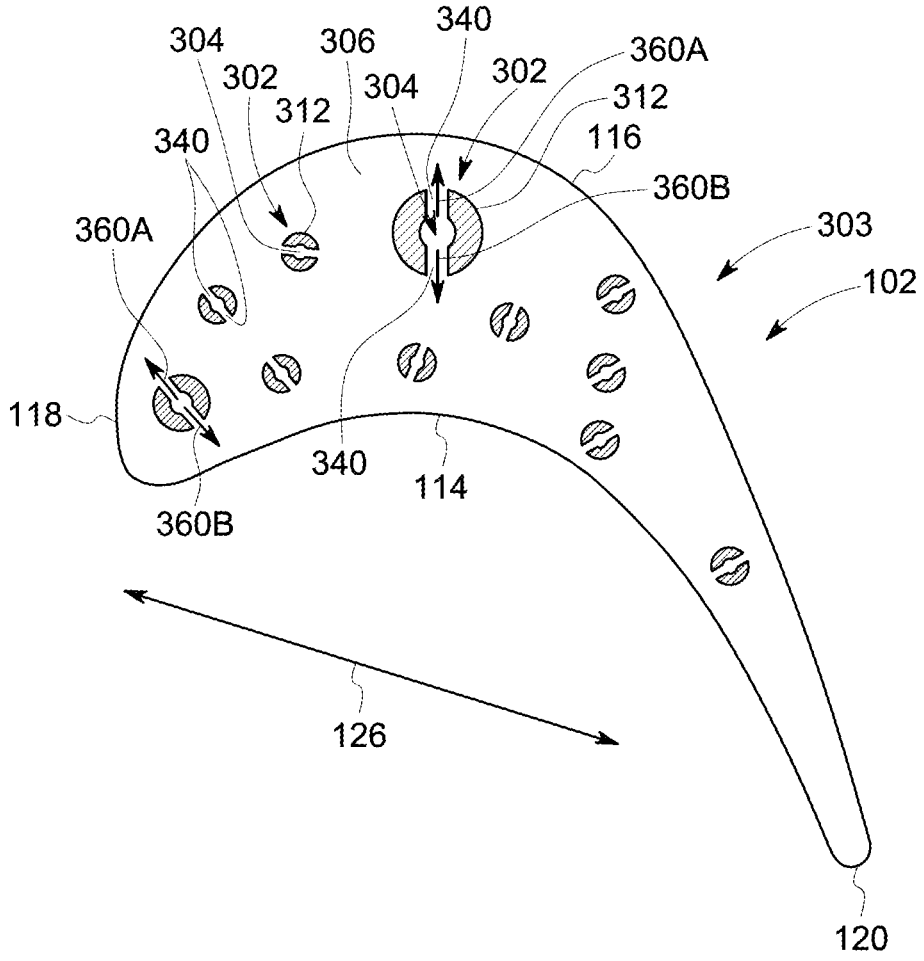
FIG. 5 illustrates a cross-sectional view of a tip end of the airfoil of FIG. 2 in accordance with one embodiment.

FIG. 5 illustrates a cross-sectional top view of section A-A of FIG. 2 in accordance with one embodiment. The section A-A extends through the first chamber 306 of the airfoil 102 at a position proximate the inner floor surface 322 of the tip floor 132. In the illustrated embodiment, the cooling assembly 303 includes eleven pins 302 that are disposed inside the first chamber 306. The pins 302 have varying shapes, orientations, and sizes, and are disposed in a random configuration between the pressure side 114, suction side 116, leading edge 118 and trailing edge 120. Optionally, the cooling assembly 303 may include any number of pins 302 that may have any unique and/or common shapes, orientations, or sizes, that may be disposed in any patterned or random configuration inside the first chamber 306, or any combination therein.

In the illustrated embodiment, a cooling conduit 304 is placed inside each pin 302, and two conduit channels 340 are fluidly coupled with each cooling conduit 304. The two conduit channels 340 of each pin 302 extend in substantially uniformly opposite directions from each other, but extend in random directions from each other exhaust channels 340 of each other pin 302. Optionally, each exhaust channel 340 of each pin 302 may extend in a common direction or at a common angular position about each pin axis 314. Optionally, each cooling conduit 304, each conduit channel 340, or each pin 302 may have any common or unique confirmation, shape, size, orientation, or the like, relative to each other cooling conduit 304, each other conduit channel 340, or each other pin 302.

Additionally, the pins 302 may be disposed inside any turbine assembly 10 component. Non-limiting examples of such components include a vane, nozzle, shroud, combustor, compressor, or the like. For example, the pins may be integrated with or operably coupled with two surfaces of a combustion chamber of the turbine assembly 10 such that the pins may increase a structure load support level of a combustor wall relative to the first and second ends of each pin not being operably coupled with or integrated with the two surfaces of the combustion chamber. Additionally, the cooling conduit disposed inside each pin may direct coolant to the combustor wall or any alternative surface of the combustion chamber in order to manage a temperature of the combustion chamber and the combustor wall.

Figure 6:
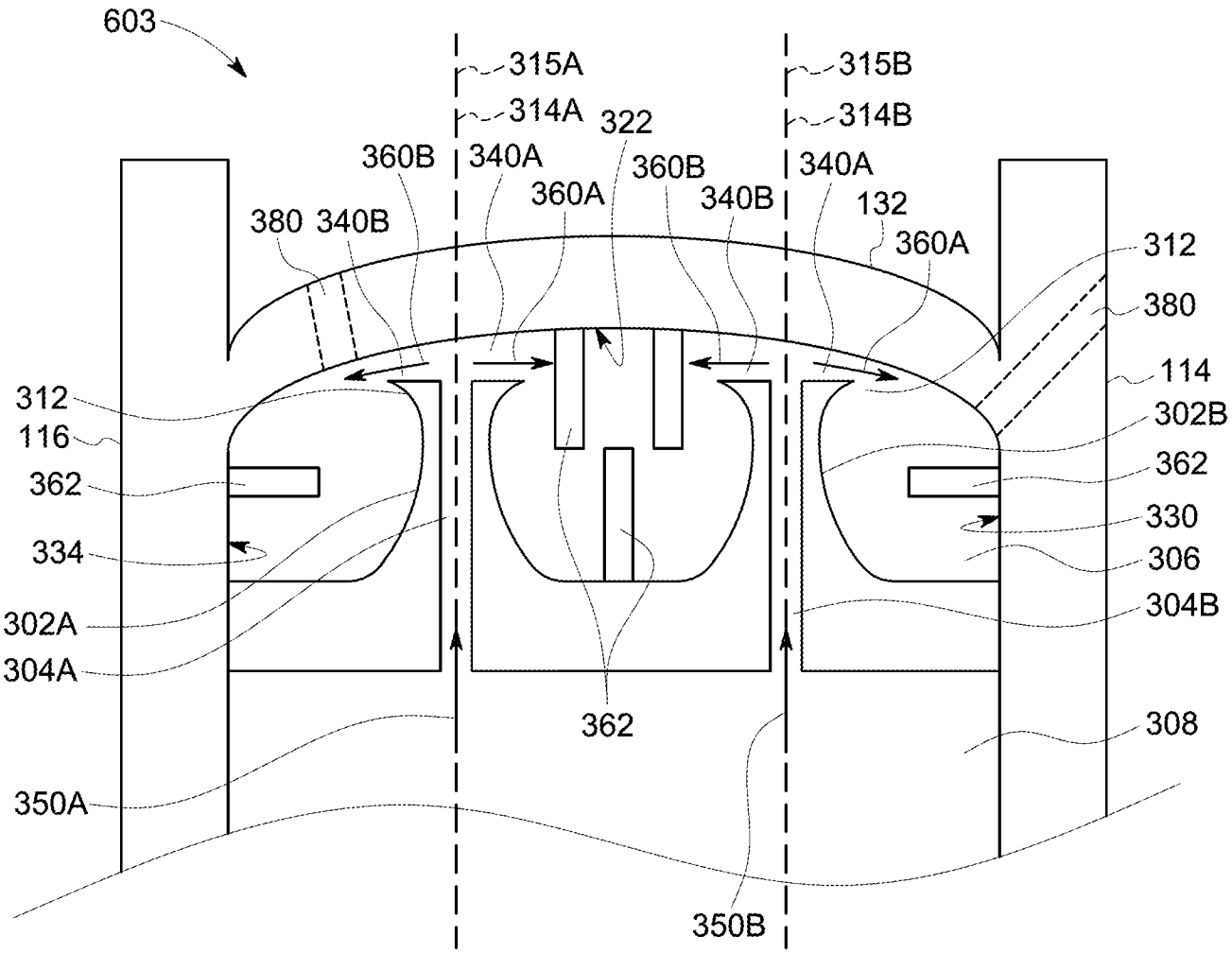
FIG. 6 illustrates a cross-sectional front view of a cooling assembly in accordance with one embodiment.

FIG. 6 illustrates a partial cross-sectional view of a cooling assembly 603 in accordance with one embodiment. The cooling assembly 603 includes two pins 302A, 302B that are disposed inside the first chamber 306. The pins 302A, 302B are substantially uniform in shape and size. Additionally or alternatively, one or more of the pins 302A, 302B may have any alternative shape and/or size that is unique to the shape and/or size of the other pin 302A, 302B.

Each pin 302A, 302B includes a cooling conduit 304A, 304B that is disposed inside each of the pins 302A, 302B, respectively. The cooling conduits 304A, 304B each are elongated along and extend around conduit axis 315A, 315B. In the illustrated embodiment, the cooling conduits 304 are generally centered about the pin axis 314 between the first and second ends 310, 312 of each pin such that the pin axis 314A, 314B and the conduit axis 315A, 315B of each pin 302A, 302B extend in substantially the same directions. Additionally, the pin axis 314A of the first pin 302A and the pin axis 314B of the second pin 302B are substantially parallel along the radial length 124 (of FIG. 2). Optionally, one or more of the pin axis 314A, 314B may not be parallel to the other pin axis 314A, 314B. The cooling conduits 304A, 304B are fluidly coupled with the second chamber 308 and the first chamber 306. The first cooling conduit 304A directs some of the coolant 350A out of the second chamber 308 and towards the inner floor surface 322 at a position proximate the suction side 116 of the airfoil 102 relative to the second pin 302B. Additionally, the second cooling conduit 304B directs some of the coolant 350B out of the second chamber 308 and towards the inner floor surface 322 at a position proximate the pressure side 114 of the airfoil 102 relative to the first pin 302A.

In one or more embodiments, the cooling conduit 304B of the second pin 302B may have a larger cross-sectional shape and size relative to the cooling conduit 304A of the first pin 302A in order to direct a larger volume of coolant towards the inner floor surface 322 at a position proximate the pressure side 114 relative to a smaller volume of coolant the cooling conduit 304A of the first pin 304A may direct towards the inner floor surface 322 at a position proximate the suction side 116. For example, the cooling conduits 304 may be shaped and/or sized in order to control an amount of coolant that is directed towards the inner floor surface 322 of the tip floor 132 in order to control or manage the temperature of the inner floor surface 322 at any position of the tip floor 132 between the pressure side 114, suction side 116, leading edge 118, and trailing edge 120.

The cooling assembly 603 also includes plural conduit channels 340 that are fluidly coupled with each cooling conduit 304A, 304B. First and second conduit channels 340A, 340B of the first pin 302A direct at least some of the coolant 350 out of the cooling conduit 304A and into the first chamber 306, and first and second conduit channels 340A, 340B of the second pin 302B direct at least some of the coolant 350 out of the cooling conduit 304B and into the first chamber 306. In the illustrated embodiment, the conduit channels 340 are disposed at substantially uniform radial positions of the first and second pins 302A, 302B along the radial length 124 of each of the pins 302A, 302B. Additionally, each conduit channel 340 has a substantially uniform shape and size as each other conduit channel 340. Optionally, one or more of the conduit channels 340 may be disposed at any unique radial position of each pin 302A, 302B, may have any unique shape and/or size, or any combination therein. Optionally, the pins 302A, 302B may be positioned proximate the pressure side inner surface 330 and/or the suction side inner surface 334 such that the conduit channels 340 may direct the coolant 350 to impinge against the pressure side inner surface 330 and/or the suction side inner surface 334.

In the illustrated embodiment, the cooling assembly 603 also includes a plurality of pins or turbulators 362 that are disposed inside of the first chamber 306. For example, there are turbulators 362 positioned between the first and second pins 302A, 302B that are operably coupled with and extend a distance away from the first surface 320 and the inner floor surface 322. Additionally, there are turbulators 362 that are operably coupled with and extend a distance away from the pressure side inner surface 330 and the suction side inner surface 334. The pins or turbulators 362 direct the coolant 350 inside the first chamber 306 and around the pins or turbulators 362 in order to manage a temperature of the first chamber 306. Optionally, the cooling assembly 603 may include any number of pins, turbulators, structures, or the like that may improve the cooling of the first chamber or improve the structural support of the first chamber 306 relative to the first chamber 306 not including any pins, turbulators, structures, or the like.

Figure 7:
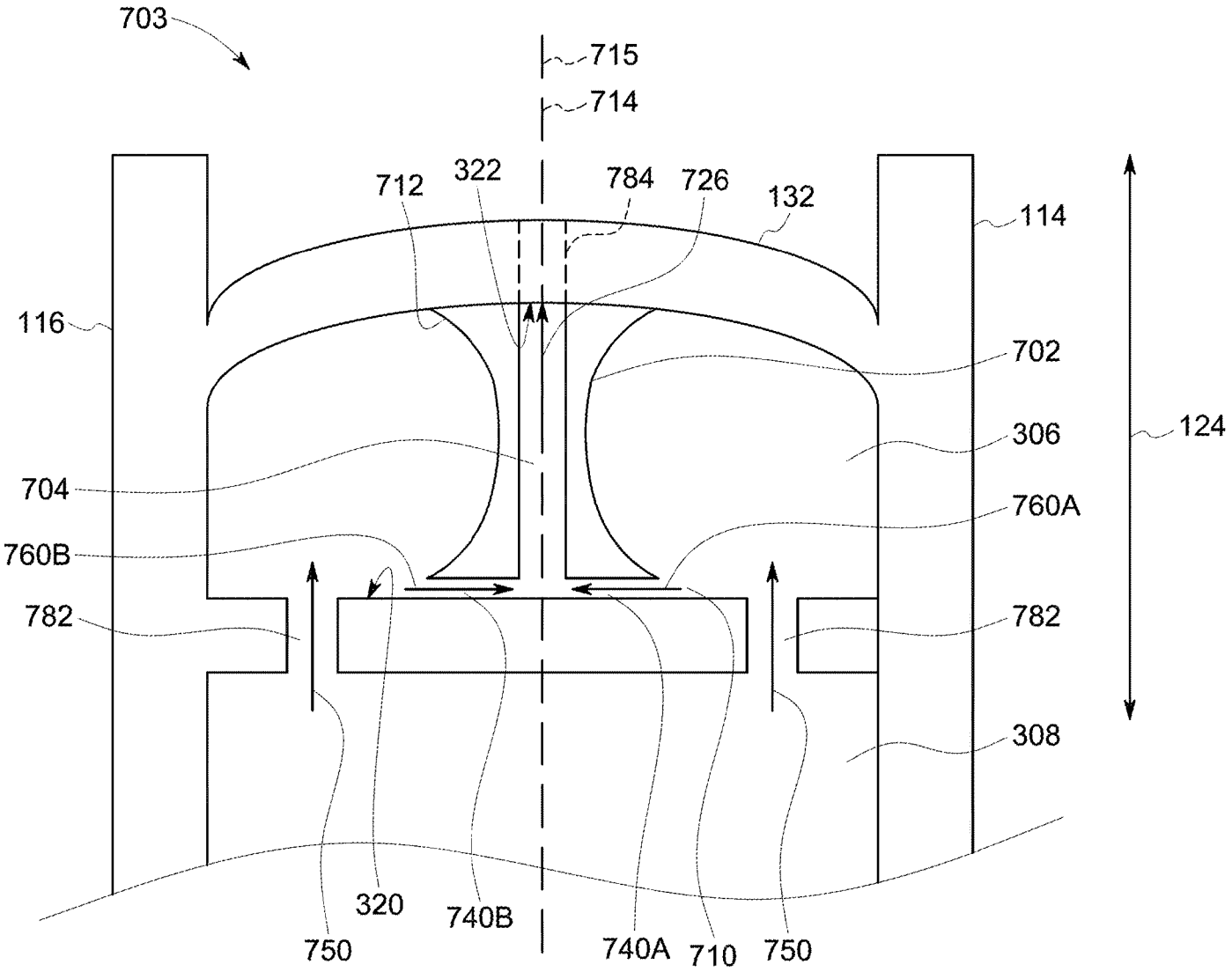
FIG. 7 illustrates a cross-sectional front view of a cooling assembly in accordance with one embodiment.

FIG. 7 illustrates a partial cross-sectional view of a cooling assembly 703 in accordance with one embodiment. The cooling assembly 703 includes a pin 702 that is disposed inside the first chamber 306 of the airfoil 102. The pin 702 has a first end 710 that is operably coupled with the first surface 320 of the first chamber 306 (not shown), and an opposite second end 712 that is operably coupled with the inner floor surface 322. For example, the pin 702 increases a structural load support level of the tip floor 132 relative to the first and second ends 710, 712 not being operably coupled with the first surface 320 and the inner floor surface 322, respectively.

The cooling assembly 703 includes a cooling conduit 704 that is disposed inside the pin 702. The cooling conduit 704 is elongated along and extends around a conduit axis 715. In the illustrated embodiment, the conduit axis 715 and the pin axis 714 extend in a common direction that is substantially parallel to the radial length 124 of the airfoil 102. Optionally, the pin axis 714 and/or the conduit axis 715 may extend between the first surface 320 and the inner floor surface 322 in any different direction that is not parallel to the radial length 124.

The cooling assembly 703 includes interior channels 782 that fluidly couple the first chamber 306 with the second chamber 308. For examples, the interior channels 782 direct some coolant 750 out of the second chamber 308 and into the first chamber 306. In the illustrated embodiment, two interior channels 782 fluidly couple the first chamber 306 with the second chamber 308. Optionally, any number of interior channels arranged in any configuration relative to the pin 702 may fluidly couple the first chamber 306 with the second chamber 308.

The cooling conduit 704 is fluidly coupled with two conduit channels 740A, 740B. The conduit channels 740A, 740B are disposed at a radial position proximate the first end 710 of the pin 702. In the cooling assembly 703 of FIG. 7, the conduit channels 740A, 740B direct coolant from the first chamber 306 and into the cooling conduit 704. For example, the first conduit channel 740A directs at least some of the coolant 750 into the cooling conduit 704 in a direction 760A, and the second conduit channel 740B directs at least some of the coolant 750 into the cooling conduit 704 in a direction 760B that is substantially parallel to and opposite the direction 760A. The cooling conduit 704 directs the coolant 750 inside the cooling conduit 704 in a first direction 726 towards the inner floor surface 322 in order to reduce the temperature of the inner floor surface 322 at the second end 712 of the pin 702 relative to the pin 702 not including the cooling conduit 704. For example, the cooling conduit 704 directs coolant 750 in the first direction 726, and the conduit channels 740A, 740B direct the coolant into the cooling conduit 704 in second directions 760A, 760B that are different than the first direction 726.

The cooling assembly 703 also includes a pin exhaust channel 784 that is fluidly coupled with the cooling conduit 704 and directs coolant out of the cooling conduit 704 and out of the airfoil 102 to the tip floor 132. For example, the pin exhaust channel 784 may direct some of the coolant 750 out of the first chamber 306 and into the cooling conduit 704. In the illustrated embodiment, the pin exhaust channel 784 directs the coolant 750 out of the airfoil 102. Optionally, the pin exhaust channel 784 may fluidly coupled the cooling conduit 704 with an additional cooling channel (not shown) in or around one or more of the tip rails 142A, 142B, with an additional cooling channel disposed inside the tip end 128 of the airfoil 102, or the like.

Figure 8:
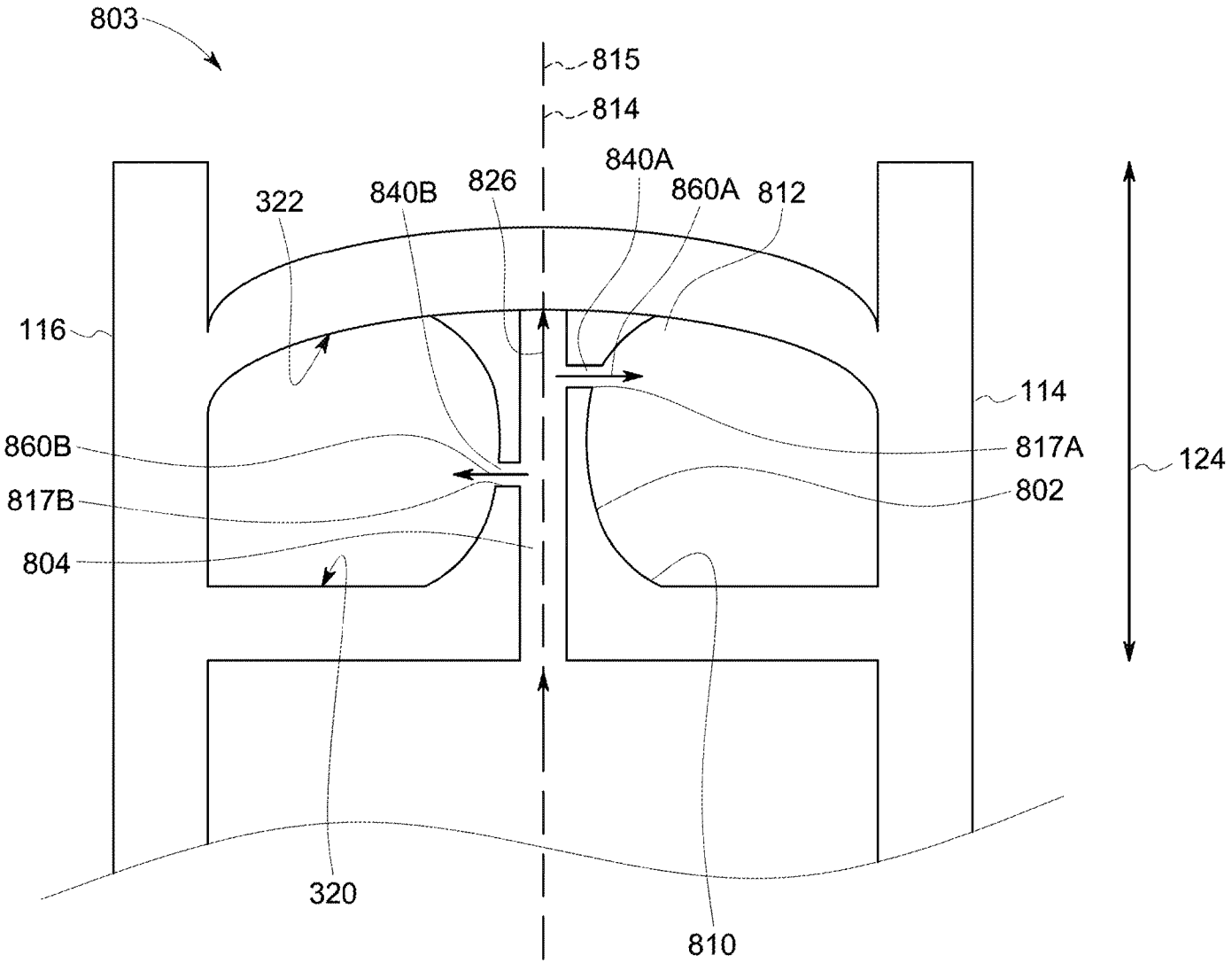
FIG. 8 illustrates a cross-sectional front view of a cooling assembly in accordance with one embodiment.

FIG. 8 illustrates a partial cross-sectional view of a cooling assembly 803 in accordance with one embodiment. The cooling assembly 803 includes a pin 802 that is disposed inside the first chamber 306 of the airfoil 102 at the tip end 128 (of FIG. 2) of the airfoil 102. The pin 802 has a first end 810 that is operably coupled with the first surface 320 of the first chamber 306 and an opposite second end 812 that is operably coupled with the inner floor surface 322 of the tip floor 132. For example, the first end 810 is integrated with the first surface 320 and the second end 812 is integrated with the inner floor surface 322 such that the pin 802 increases a structural load support level of the tip floor 132 relative to the first and second ends 810, 812 of the pin 802 not being operably coupled with the first surface 320 and inner floor surface 322, respectively.

The cooling assembly 803 includes a cooling conduit 804 that is placed inside the pin 802 that is elongated along and extends around a conduit axis 815 that extends in a common direction with the pin axis 814. The cooling conduit 804 is fluidly coupled with two conduit channels 840A, 840B. For example, the cooling conduit 804 is fluidly coupled with the first conduit channel 840A at a first radial position 817*a* of the pin 802 along the radial length of pin 802, and is fluidly coupled with the second conduit channel 840B at a different, second radial position 817*b* of the pin 802 along the radial length of the pin 802. The first conduit channel 840A directs coolant out of the cooling conduit 804 at the first radial position 817*a* that is disposed proximate to the inner floor surface 322 relative to the second conduit channel 840B. For example, the first conduit channel 840A directs coolant out of the cooling conduit 804 closer to the second end 812 of the pin 802 relative to the second conduit channel 840B that directs coolant out of the cooling conduit 804 closer to the first end 810 of the pin 802.

In the illustrated embodiment, the first conduit channel 840A directs coolant in a direction 860A out of the cooling conduit 804 and into the first chamber 306 and the second conduit channel 840B directs coolant in a direction 860B out of the cooling conduit 804 that is substantially parallel to and opposite the direction 860A. Additionally or alternatively, the cooling assembly 803 may include any number of conduit channels 840 that may direct coolant into and/or out of the cooling conduit 804 in any common or unique directions.

Figure 9:
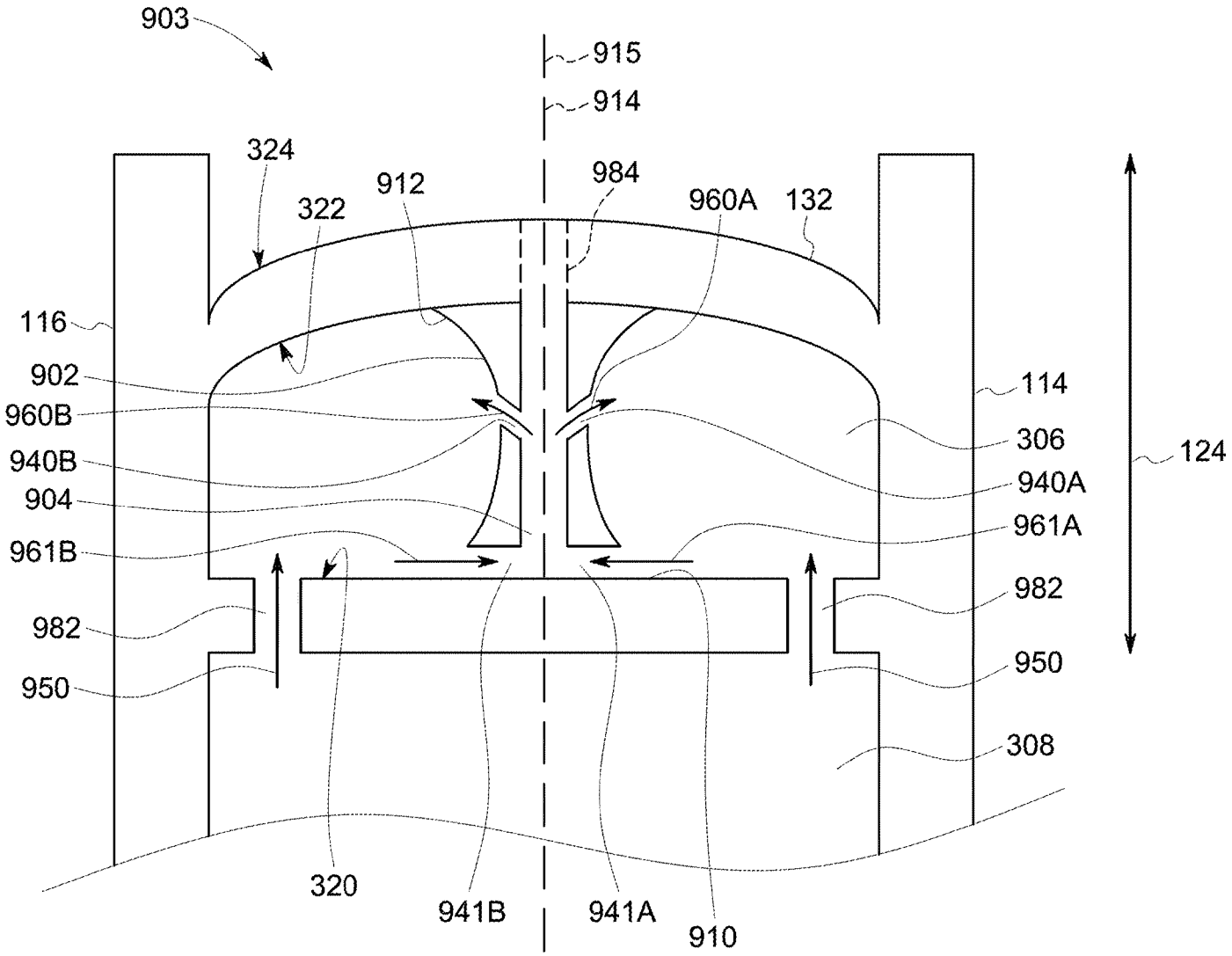
FIG. 9 illustrates a cross-sectional front view of a cooling assembly in accordance with one embodiment.

FIG. 9 illustrates a partial cross-sectional view of a cooling assembly 903 in accordance with one embodiment. The cooling assembly 903 includes a pin 902 that is disposed inside the first chamber 306 of the airfoil 102. The pin 902 extends between a first end 910 and an opposite second end 912 along a pin axis 914. The first end 910 is operably coupled with the first surface 320 of the first chamber 306 and the second end 912 is operably coupled with the inner floor surface 322. For example, the first end 910 is integrated with the first surface 320 and the second end 912 is integrated with the inner floor surface 322 such that the pin 902 increases a structural load support level of the tip floor 132 relative to the first and second ends 910, 912 of the pin 902 not being operably coupled with the first surface 320 and inner floor surface 322, respectively.

The cooling assembly 903 includes interior channels 982 that fluidly couple the first chamber 306 with the second chamber 308. For examples, the interior channels 982 direct some coolant 950 out of the second chamber 308 and into the first chamber 306. In the illustrated embodiment, two interior channels 982 fluidly couple the first chamber 306 with the second chamber 308. Optionally, any number of interior channels arranged in any configuration relative to the pin 902 may fluidly couple the first chamber 306 with the second chamber 308.

The cooling assembly 903 includes a cooling conduit 904 that is disposed inside the pin 902. The cooling conduit 904 is fluidly coupled with two conduit channels 941A, 941B. The conduit channels 941A, 941B are disposed at a radial position proximate the first end 910 of the pin 902. The conduit channels 941A, 941B direct coolant from the first chamber 306 into the cooling conduit 904. For example, the first conduit channel 941A directs at least some of the coolant 950 into the cooling conduit 904 in a direction 961A, and the second conduit channels 941B directs at least some of the coolant 950 into the cooling conduit 904 in a direction 961B that is substantially parallel to and opposite the direction 961A.

The cooling assembly 903 also includes two conduit channels 940A, 940B that fluidly couple the cooling conduit 904 with the first chamber 306. The conduit channels 940A, 940B direct some of the coolant 950 out of the cooling conduit 904 in directions 960A, 960B that are substantially mirrored about the pin axis 914 and are not parallel with and are not perpendicular to the pin axis 914. Additionally, the conduit channels 940A, 940B direct the coolant 950 in directions 960A, 960B that are different than a direction of the coolant inside the cooling conduit 904.

The cooling assembly 903 also includes a pin exhaust channel 984 that is fluidly coupled with the cooling conduit 904 and directs coolant out of the cooling conduit 904 and out of the airfoil 102 to the tip floor 132. For example, the pin exhaust channel 984 may direct some coolant 950 out of the cooling conduit 904 and out of the airfoil 102 in order to manage the temperature of the tip floor 132 of the airfoil 102. Optionally, the pin exhaust channel 984 may not be an open passage at the tip floor 132. For example, the pin exhaust channel 984 may direct coolant 950 towards the inside surface of the outer floor surface 324 in order to manage the temperature of tip floor 132 inside the airfoil 102.

Figure 10:
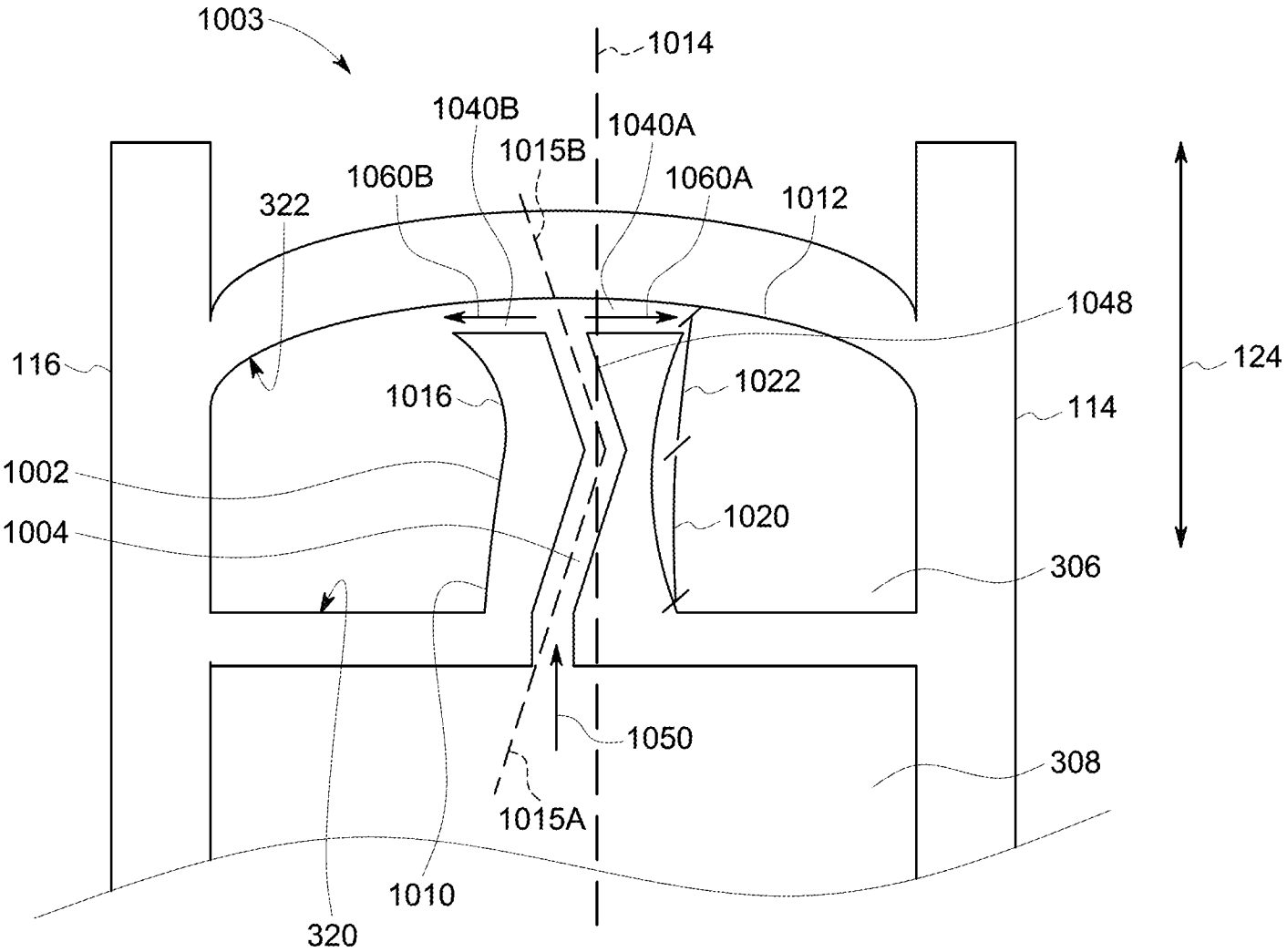
FIG. 10 illustrates a cross-sectional top view of a cooling assembly in accordance with one embodiment.

FIG. 10 illustrates a partial cross-sectional view of a cooling assembly 1003 in accordance with one embodiment. The cooling assembly 1003 includes a pin 1002 that is disposed inside the first chamber 306 of the airfoil 102. The pin 1002 extends between a first end 1010 and a second end 1012. The first end 1010 is operably coupled with the first surface 320 of the first chamber 306, and the second end 1012 is operably coupled with the inner floor surface 322 of the tip floor 132. For example, the first end 1010 is integrated with the first surface 320 and the second end 1012 is integrated with the inner floor surface 322 such that the pin 1002 increases a structural load support level of the tip floor 132 relative to the first and second ends 1010, 1012 not being operably coupled with the first surface 320 and the inner floor surface 322, respectively.

The pin 1002 has an exterior surface 1016 that extends circumferentially about the pin 1002 and radially between the first and second ends 1010, 1012 along a pin axis 1014. In the illustrated embodiment, the exterior surface 1016 of the pin 1002 has a non-uniform shape between the first and second ends 1010, 1012 in a direction along the pin axis 1014. For example, the pin 1002 has a first end circumference at a radial position proximate the first end 1010 that is larger than a center circumference at a radial position substantially centered between the first and second ends 1010, 1012. Additionally, the first end circumference is smaller than a second end circumference at a radial position proximate the second end 1012. Optionally, the pin 1002 may have any alternative cross-sectional shape and size between the first end 1010 and the second end 1012 along the pin axis 1014.

The cooling assembly 1003 includes a cooling conduit 1004 that is disposed inside the pin 1002. The cooling conduit 1004 is fluidly coupled with the second chamber 308 at the first end 1010 of the pin 1002. The cooling conduit 1004 is elongated along and extends around a first conduit axis 1015A within a first portion 1020 of the pin 1002, and is elongated along and extends around a second conduit axis 1015B within a second portion 1022 of the pin 1002. The first conduit axis 1015A extends in a direction that is different than a direction of the second conduit axis 1015B. Additionally, the first and second conduit axis 1015A, 1015B extend in directions that are different than the direction of the pin axis 1014. For example, the pin axis 1014 extends in a first direction that is substantially parallel to the radial length 124, and the conduit axis 1015A, 1015B extend in different directions that are not parallel with and are not perpendicular to the radial length 124. Optionally, the cooling conduit 1004 may be elongated along any number of axis that may extend in any direction that may be unique, parallel, perpendicular, common, or any combination therein, to any other axis and/or the radial length 124.

The cooling conduit 1004 has an exterior surface 1048 that extends circumferentially about the first and second conduit axis 1015A, 1015B and radially between the first and second ends 1010, 1012. In the illustrated embodiment, the exterior surface 1048 has a substantially uniform tubular shape along the first conduit axis 1015A and along the second conduit axis 1015B. Additionally or alternatively, the conduit 1004 may have any alternative shape and/or size within the first portion 1020 and/or the second portion 1022 of the pin 1002. For example, the cooling conduit 1004 may have a first diameter along the first conduit axis 1015A within the first portion 1020 of the pin 1002 that is larger than a second diameter along the second conduit axis 1015B within the second portion 1022 of the pin 1002. Optionally, the cooling conduit 1004 may have a circular cross-sectional shape with a decreasing circumference along the first conduit axis 1015A and with a uniform circumference along the second conduit axis 1015B. Optionally, the cooling conduit 1004 may have any alternative uniform or common shape between the first end 1010 and the second end 1012 of the pin 1002.

The cooling assembly 1003 also includes two conduit channels 1040A, 1040B that fluidly couple the cooling conduit 1004 with the first chamber 306. The cooling conduit 1004 directs some of the coolant 1050 out of the second chamber 308 towards the inner floor surface 322. The conduit channels 1040A, 1040B direct some of the coolant 1050 out of the cooling conduit 1004 in directions 1060A, 1060B. Optionally, the cooling assembly 1003 may include any number of conduit channels 1040 that may be disposed at any radial position of the pin 1002 between the first end 1010 and the second end 1012 in order to direct some coolant 1050 out of the cooling conduit and into the first chamber 306.

Figure 11:
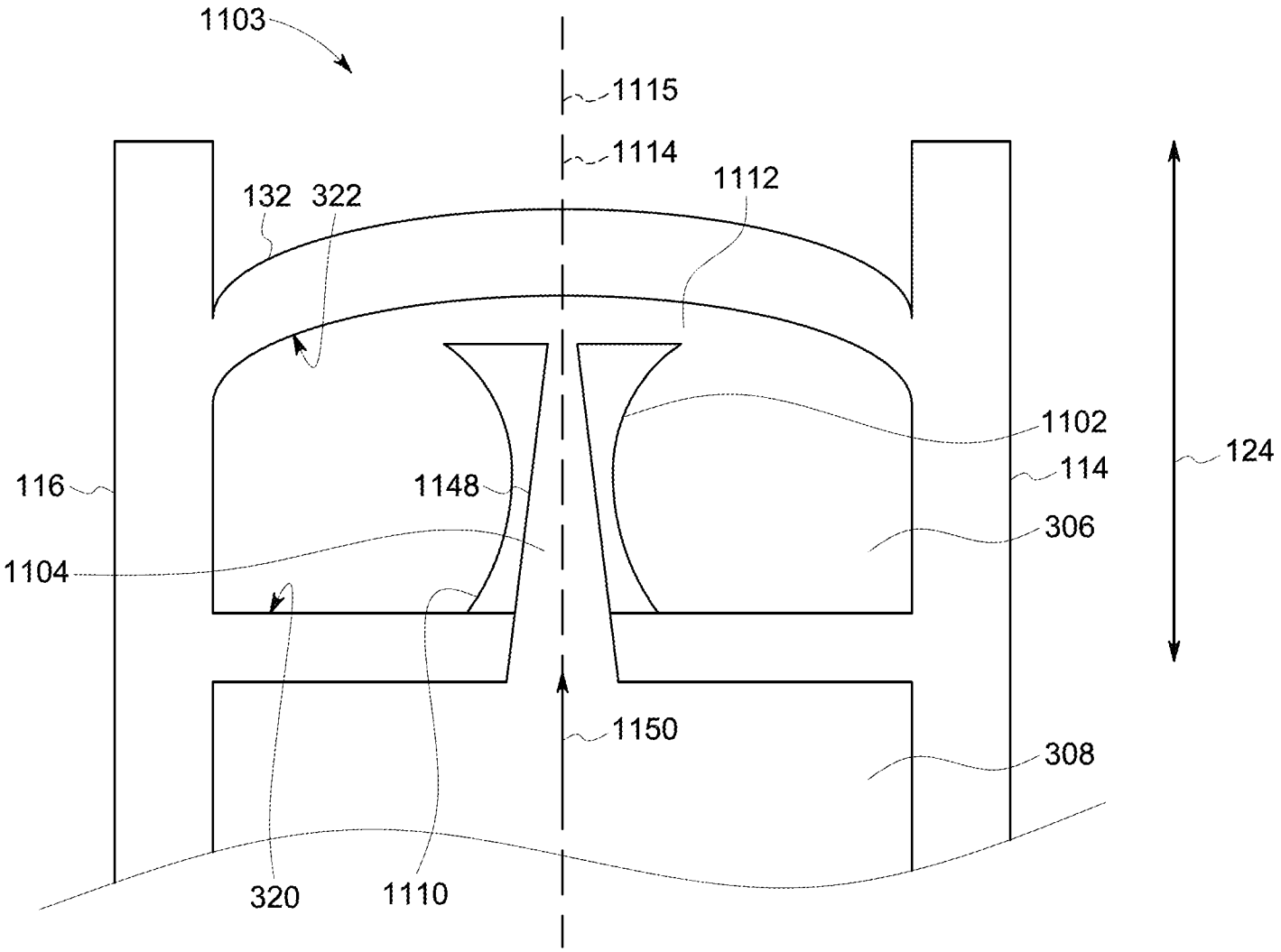
FIG. 11 illustrates a cross-sectional top view of a cooling assembly in accordance with one embodiment.

FIG. 11 illustrates a partial cross-sectional view of a cooling assembly 1103 in accordance with one embodiment. The cooling assembly 1103 includes a pin 1102 that is disposed inside the first chamber 306 of the airfoil 102. The pin 1102 extends between a first end 1110 and a second end 1112 along a pin axis 1114. The first end 1110 is operably coupled with the first surface 320 of the first chamber 306 and the second end 1112 is operably coupled with the inner floor surface 322 of the tip floor 132.

The cooling assembly 1103 includes a cooling conduit 1104 that is disposed inside the pin 1102. The cooling conduit 1104 is elongated along and extends around a conduit axis 1115 that extends in a common direction with the pin axis 1114. The cooling conduit 1104 is fluidly coupled with the second chamber 308 and the first chamber 306. For example, the cooling conduit 1104 directs some of the coolant 1150 out of the second chamber 308 and towards the inner floor surface 322 of the tip floor 132, and conduit channels direct some of the coolant out of the cooling conduit 1104 and into the first chamber 306.

The cooling conduit 1104 has an exterior surface 1148 that extends circumferentially about the conduit axis 1115 and radially between the first and second ends 1110, 1112 of the pin 1102. In the illustrated embodiment, the exterior surface 1148 has a decreasing circumference along the conduit axis 1115 between the first end 1110 and the second end 1112. For example, the cooling conduit 1104 has a first diameter along the conduit axis 1115 at a radial position proximate the first end 1110 of the pin 1102. The first diameter is larger than a second diameter along the conduit axis 1115 at a radial position proximate a center position between the first and second ends 1110, 1112 of the pin 1102. Additionally, the first diameter (e.g., near the first end 1110) and the second diameter (e.g., proximate the radial center of the pin) are larger than a third diameter along the conduit axis 1115 at a radial position proximate the second end 1112 of the pin 1102. Additionally or alternatively, the conduit 1104 may have any alternative shape and/or size along the conduit axis 1115.

Figure 12:
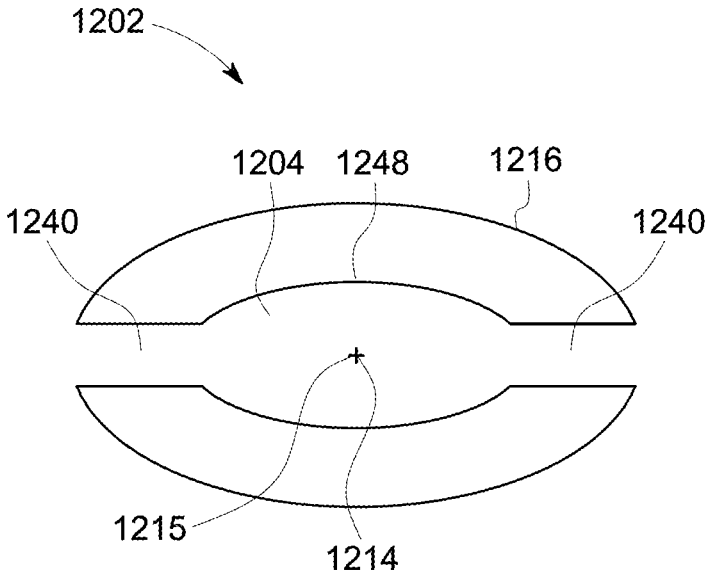
FIG. 12 illustrates a cross-sectional view of a pin in accordance with one embodiment.

FIG. 12 illustrates a cross-sectional view of a pin 1202 in accordance with one embodiment. The cross-sectional view of pin 1202 may be through any radial position of the pin 1202 between a first end and second end of the pin 1202. For example, the cross-sectional view may be through any radial position of the pin at a radial location of conduit channels 1240. The pin 1202 has an exterior surface 1216 that extends circumferentially around a pin axis 1214. Additionally, a cooling conduit 1204 has an exterior surface 1248 that extends circumferentially about a conduit axis 1215 that extends in a common direction with the pin axis 1214. In the illustrated embodiment, the exterior surface 1216 of the pin 1202 and the exterior surface 1248 of the cooling conduit 1204 have substantially concentric oval cross-sectional shapes about the pin axis 1214. Optionally, the pin 1202 and/or the cooling conduit 1204 may have any alternative cross-sectional shapes that may or may not be concentric.

The conduit channels 1240 fluidly couple the cooling conduit 1204 with the first chamber (not shown). In the illustrated embodiment, two conduit channels 1240 have substantially uniform shapes and sizes. Additionally, the two conduit channels 1240 are disposed on opposite sides of the pin axis 1214 such that the two conduit channels 1240 are substantially mirrored about the pin axis 1214. Optionally, one or more additional conduit channels may be disposed at an alternative radial position of the pin 1202 (e.g., not shown) that may extend in any angular position about the pin axis 1214.

In the illustrated embodiment of FIG. 12, the cooling assembly includes a single cooling conduit 1204 disposed inside a pin 1202 (not shown). Optionally, plural cooling conduits 1204 may be disposed inside the pin 1202. For example, two or more cooling conduits 1204 may be disposed inside the pin 1202, and each cooling conduit 1204 may be fluidly coupled with one or more of the conduit channels 1240. Optionally, one or more cooling conduits 1204 may not be fluidly coupled with the conduit channels 1240. Optionally, the cooling assembly may include any number of cooling conduits disposed inside the pin 1202 in any random or patterned configuration.

Figure 13:
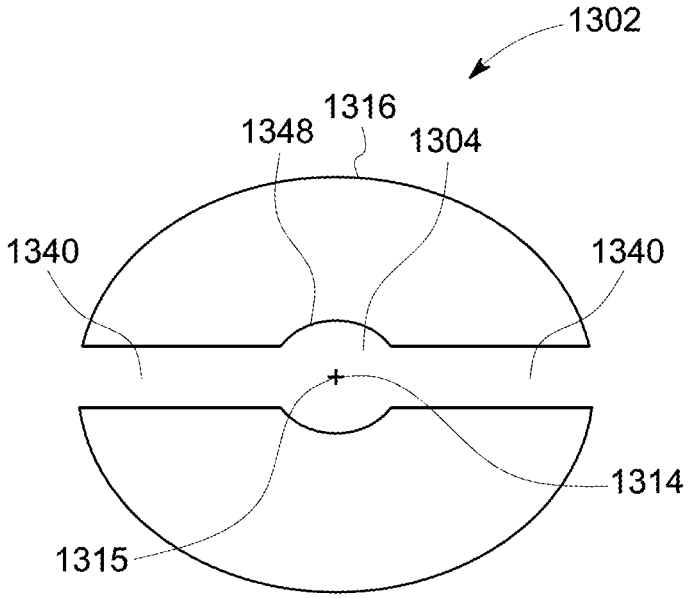
FIG. 13 illustrates a cross-sectional view of a pin in accordance with one embodiment.

FIG. 13 illustrates a cross-sectional view of a pin 1302 in accordance with one embodiment. The pin 1302 has an exterior surface 1316 that extends circumferentially about a pin axis 1314. Additionally, a cooling conduit 1304 has an exterior surface 1348 that extends circumferentially about a conduit axis 1315. In the illustrated embodiment, the exterior surface 1348 of the cooling conduit 1304 of FIG. 13 has a diameter than is smaller than a diameter of the exterior surface 1248 of the cooling conduit 1204 of FIG. 12. Optionally, the cooling conduit 1204 may have a shape and/or size that is larger or smaller than the cooling conduit 1304, or may have any alternative shape and/or size.

Two conduit channels 1340 fluidly couple the cooling conduit 1304 with the first chamber (not shown). In the illustrated embodiment, the two conduit channels 1340 of FIG. 13 have a shape and size that is substantially uniform to the shape and size of the conduit channels 1240 of FIG. 12. Optionally, the conduit channels 1340 may have a shape and/or size that is unique to the shape and/or size of the channels 1240. Optionally, one of the conduit channels 1340 may have a shape or size that is different than a shape or size of the other conduit channel 1340.

Figure 14:
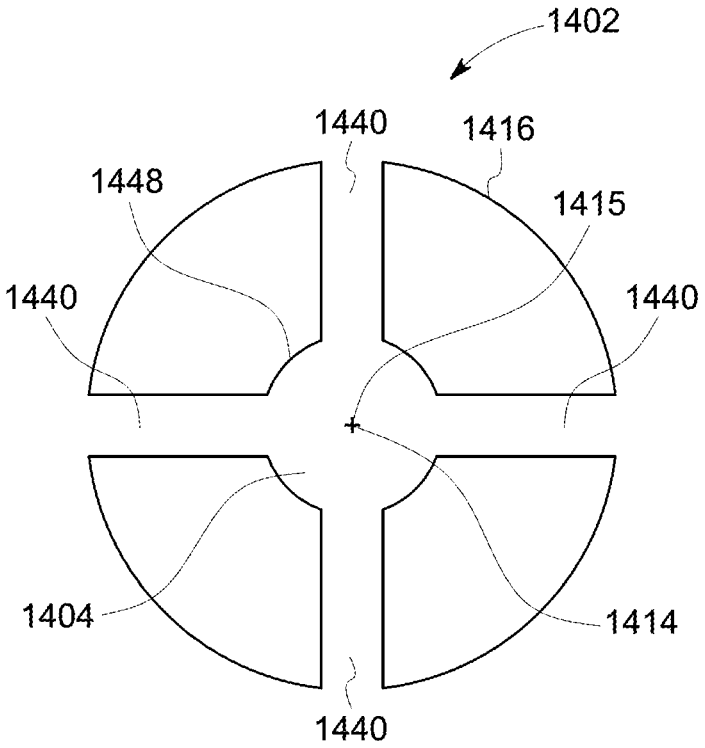
FIG. 14 illustrates a cross-sectional view of a pin in accordance with one embodiment.

FIG. 14 illustrates a cross-sectional view of a pin 1402 in accordance with one embodiment. The pin 1402 has an exterior surface 1416 that extends circumferentially about a pin axis 1414 that is substantially concentric with an exterior surface 1448 of a cooling conduit 1404 about a conduit axis 1415. Four conduit channels 1440 fluidly couple the cooling conduit 1404 with the first chamber (not shown). In the illustrated embodiment, the four conduit channels 1440 are disposed substantially 90 degrees angularly apart from each other exhaust channel 1440. Optionally, one or more of the four conduit channels 1440 may be placed at uniform, unique, patterned, random, or the like, positions apart from each other exhaust channel 1440.

Figure 15:
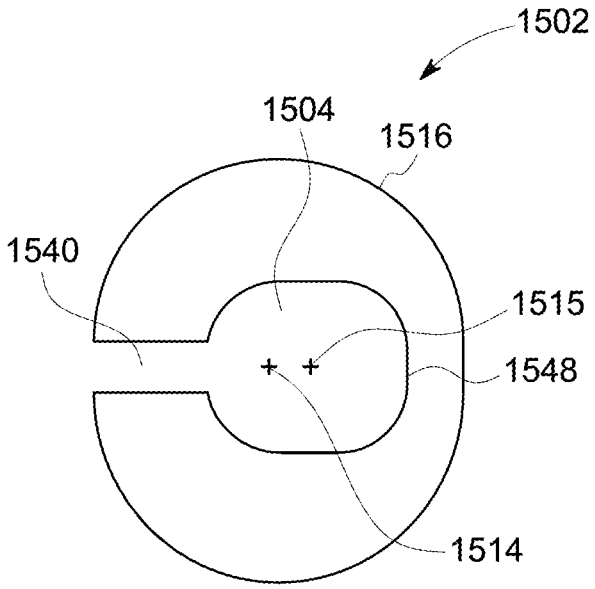
FIG. 15 illustrates a cross-sectional view of a pin in accordance with one embodiment.

FIG. 15 illustrates a cross-sectional view of a pin 1502 in accordance with one embodiment. The pin 1502 has an exterior surface 1516 that extends about a pin axis 1514. The exterior surface 1516 of the pin 1502 is not substantially concentric with an exterior surface 1548 of a cooling conduit 1504 that extends about a conduit axis 1515. A conduit channel 1540 fluidly couples the cooling conduit 1504 with the first chamber (not shown). The cross-sectional view of the pin 1502 may be through a first radial position of the pin 1502 between a first end and a second end of the pin 1502. Optionally, one or more additional conduit channels 1540 may be disposed at an alternative radial position of the pin 1502 (e.g., not shown) that may extend in any angular position about the pin axis 1514.

FIGS. 3 through 15 illustrate numerous embodiments of cooling assemblies inside the airfoil 102. Additionally or alternatively, one or more features or components of the cooling assemblies illustrated in FIGS. 3 through 15 may be combined in any combination, configuration, or the like. Optionally, a cooling assembly may have any number of pins having any configuration disposed inside the first chamber in order to increase a structural load support level of the tip floor of the airfoil. Optionally, a cooling assembly may have any number of unique and/or commonly shaped cooling conduits disposed inside each pin. Optionally, the pins, the cooling conduits, or the conduit channels may have any alternative shape, size, orientation, configuration, or the like.

Figure 16:
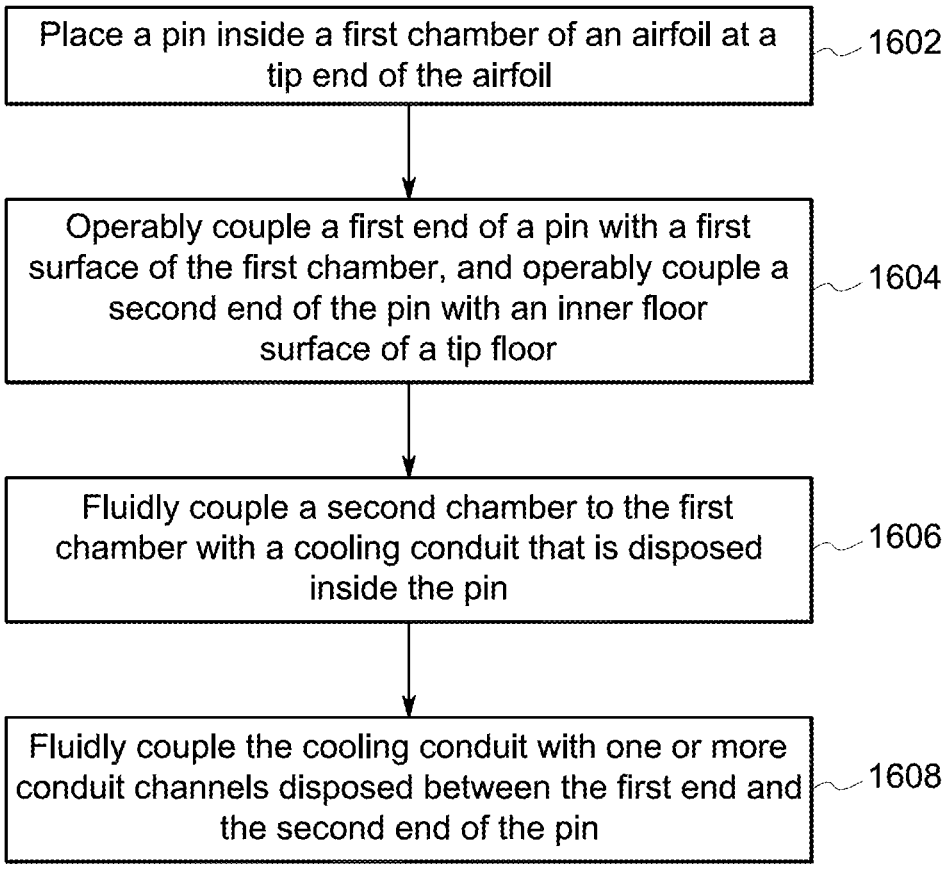
FIG. 16 illustrates a flowchart of a method for cooling an airfoil in accordance with one embodiment.

FIG. 16 illustrates a flowchart of a method 1600 for increasing a structural load support level of a tip floor of an airfoil and cooling the tip floor of the airfoil in accordance with one embodiment. At 1602, a pin (e.g., pins 302, 702, 802, 902, 1002, 1102) is disposed inside a first chamber of an airfoil. The first chamber is disposed at a tip end of the airfoil along the radial length of the airfoil.

At 1604, a first end of the pin is operably coupled with a first surface of the first chamber, and a second end of the pin is operably coupled with an inner floor surface of the tip floor. For example, the first and second ends of the pin are integrated with the first surface and inner floor surface such that the pin increases a structural load support level of the tip floor relative to the first and second ends of the pin not being integrated with the first surface and inner floor surface, respectively.

At 1606, a cooling conduit that is placed inside of the pin fluidly couples a second chamber with the first chamber. For example, the cooling conduit is configured to direct some coolant out of the second chamber and into the first chamber. Additionally, the cooling conduit is configured to direct some of the coolant towards the inner floor surface in order to manage a temperature or the tip floor.

At 1608, one or more conduit channels fluidly couple the cooling conduit with the first chamber. The conduit channels may be disposed at any radial position of the pin. For example, the conduit channels may direct some coolant out of the cooling conduit or may direct some coolant into the cooling conduit.

Optionally, the cooling assembly may include one or more exterior exhaust channels that fluidly couple the first chamber and/or the second chamber with one or more exterior surfaces of the airfoil. For example, the exterior exhaust channels may direct some of the coolant out of the first chamber and out of the airfoil at a location along any exterior surface of the airfoil. Additionally, the exterior exhaust channels may direct some of the coolant out of the second chamber and out of the airfoil at a location along any exterior surface of the airfoil.

Optionally, the cooling assembly may include one or more interior channels that fluidly couple any chamber disposed inside the airfoil with any other chamber disposed inside the airfoil. For example, the interior channels may direct some of the coolant out of the second chamber and into the first chamber in order to manage a temperature of the first and second chambers.

Optionally, the cooling assembly may include a pin exhaust channel that fluidly couples the cooling conduit with the tip floor. For example, the cooling conduit may direct coolant out of the cooling conduit and out of the airfoil at a location along the tip floor through the pin exhaust channel. Optionally, the pin exhaust channel may not be an open passage between the cooling conduit and the tip floor. For example, the pin exhaust channel may extend to any position inside the tip floor (e.g., between an inner floor surface and an outer floor surface of the tip floor) such that the cooling conduit may direct coolant to any location inside of the tip floor in order to manage the temperature of the tip floor.

In one embodiment of the subject matter described herein, a cooling assembly comprises a pin disposed inside a first chamber of an airfoil that extends from a hub end to a tip end along a radial length of the airfoil. The first chamber of the airfoil is disposed inside the tip end of the airfoil. The tip end of the airfoil comprises a tip floor. The pin extends from a first end to a second end along a pin axis. The first end of the pin is configured to be operably coupled with a first surface of the first chamber in the airfoil and the second end of the pin is configured to be operably coupled with an inner floor surface of the tip floor such that the pin increases a structural load support level of the tip floor relative to the first end of the pin not being operably coupled with the first surface of the first chamber and the second end of the pin not being operably coupled with the inner floor surface of the tip floor. The cooling assembly also comprises a cooling conduit configured to be placed inside the pin through which coolant flows. The cooling conduit is elongated along and extends around a conduit axis. The cooling conduit is fluidly coupled with one or more conduit channels disposed between the first end of the pin and the second end of the pin. The one or more conduit channels are configured to direct the coolant out of the cooling conduit or direct the coolant into the cooling conduit.

Optionally, the cooling assembly also includes a second chamber of the airfoil fluidly coupled with the cooling conduit. The cooling conduit is configured to direct the coolant from the second chamber to the first chamber.

Optionally, the cooling conduit is configured to direct the coolant from the second chamber in a first direction, and the one or more conduit channels are configured to direct the coolant out of the cooling conduit or direct the coolant into the cooling conduit in a different, second direction.

Optionally, the cooling assembly also includes a pressure side inner surface of the airfoil and a suction side inner surface of the airfoil. The first chamber is configured to extend between the pressure side inner surface of the airfoil and the suction side inner surface of the airfoil inside the tip end of the airfoil.

Optionally, the one or more conduit channels are configured to direct the coolant out of the cooling conduit to the pressure side inner surface of the airfoil or to the suction side inner surface of the airfoil.

Optionally, the first end of the pin is configured to be integrated with the first surface of the first chamber, and the second end of the pin is configured to be integrated with the inner floor surface of the tip floor.

Optionally, the cooling conduit is configured to direct the coolant to the inner floor surface of the tip floor.

Optionally, the pin axis is configured to extend in a first direction and the conduit axis is configured to extend in a different, second direction.

Optionally, the cooling assembly also includes one or more interior channels. The first chamber is fluidly coupled with the second chamber by the one or more interior channels Optionally, the cooling assembly also includes plural turbulators disposed inside the first chamber. The plural turbulators are configured to direct the coolant around the plural turbulators inside the first chamber.

In one embodiment of the subject matter described herein, a cooling assembly comprises a pin disposed inside a first chamber of an airfoil that extends from a hub end to a tip end along a radial length of the airfoil. The first chamber of the airfoil is disposed inside the tip end of the airfoil. The tip end of the airfoil comprises a tip floor. The pin extends from a first end to a second end along a pin axis. The first end of the pin is configured to be operably coupled with a first surface of the first chamber in the airfoil and the second end of the pin is configured to be operably coupled with an inner floor surface of the tip floor such that the pin increases a structural load support level of the tip floor relative to the first end of the pin not being operably coupled with the first surface of the first chamber and the second end of the pin not being operably coupled with the inner floor surface of the tip floor. The cooling assembly also comprises a cooling conduit configured to be placed inside the pin through which coolant flows. The cooling conduit is elongated along and extends around a conduit axis. The cooling conduit is fluidly coupled with one or more conduit channels disposed between the first end of the pin and the second end of the pin. The one or more conduit channels are configured to direct the coolant out of the cooling conduit or direct the coolant into the cooling conduit. The cooling assembly also comprises a second chamber disposed inside the airfoil. The second chamber is fluidly coupled with the cooling conduit. The cooling conduit is configured to direct the coolant from the second chamber to the first chamber.

Optionally, the cooling conduit is configured to direct the coolant from the second chamber in a first direction, and the one or more conduit channels are configured to direct the coolant out of the cooling conduit or direct the coolant into the cooling conduit in a different, second direction.

Optionally, the cooling assembly also includes a pressure side inner surface of the airfoil and a suction side inner surface of the airfoil. The first chamber is configured to extend between the pressure side inner surface of the airfoil and the suction side inner surface of the airfoil inside the tip end of the airfoil.

Optionally, the first end of the pin is configured to be integrated with the first surface of the first chamber, and the second end of the pin is configured to be integrated with the inner floor surface of the tip floor.

Optionally, the cooling conduit is configured to direct the coolant to the inner floor surface of the tip floor.

Optionally, the pin axis is configured to extend in a first direction and the conduit axis is configured to extend in a different, second direction.

Optionally, the cooling assembly also includes one or more interior channels. The first chamber is fluidly coupled with the second chamber by the one or more interior channels Optionally, the cooling assembly also includes plural turbulators disposed inside the first chamber. The plural turbulators are configured to direct the coolant around the plural turbulators inside the first chamber.

In one embodiment of the subject matter described herein, a cooling assembly comprises plural pins disposed inside a first chamber of a component of a turbine assembly that extends from a hub end to a tip end along a radial length. The tip end comprises a tip floor. Each pin extends from a first end to a second end along a pin axis of each pin. The first end of each pin is configured to be operably coupled with a first surface of the first chamber and the second end of each pin is configured to be operably coupled with an inner floor surface of the tip floor such that the pins increase a structural load support level of the tip floor relative to the first ends of the pins not being operably coupled with the first surface of the first chamber and the second ends of the pins not being operably coupled with the inner floor surface of the tip floor. The cooling assembly also comprising a cooling conduit configured to be places inside each pin through which coolant flows. Each cooling conduit is elongated and extends around a conduit axis. The cooling conduits are fluidly coupled with one or more conduit channels disposed between the first end of the pin and the second end of the pin. The one or more conduit channels are configured to direct the coolant out of the cooling conduit or direct the coolant into the cooling conduit.

Optionally, the cooling assembly also includes a second chamber fluidly coupled with the cooling conduit. The cooling conduit is configured to direct the coolant from the second chamber to the first chamber.

As used herein, an element or step recited in the singular and proceeded with the word "a" or "an" should be understood as not excluding plural of said elements or steps, unless such exclusion is explicitly stated. Furthermore, references to "one embodiment" of the presently described subject matter are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the subject matter set forth herein without departing from its scope. While the dimensions and types of materials described herein are intended to define the parameters of the disclosed subject matter, they are by no means limiting and are exemplary embodiments. Many other embodiments will be apparent to those of skill in the art upon reviewing the above description. The scope of the subject matter described herein should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

This written description uses examples to disclose several embodiments of the subject matter set forth herein, including the best mode, and also to enable a person of ordinary skill in the art to practice the embodiments of disclosed subject matter, including making and using the devices or systems and performing the methods. The patentable scope of the subject matter described herein is defined by the claims, and may include other examples that occur to those of ordinary skill in the art. Such other examples are intended to be within the scope of the claims if they have structural elements that do not differ from the literal language of the claims, or if they include equivalent structural elements with insubstantial differences from the literal languages of the claims.

What is claimed is:

1. A cooling assembly comprising:

a pin disposed inside a first chamber of an airfoil that extends from a hub end to a tip end along a radial length of the airfoil, the first chamber of the airfoil disposed inside the tip end of the airfoil, the tip end of the airfoil comprising a tip floor, the pin extending from a first end to a second end along a pin axis, the first end of the pin configured to be operably coupled with a first surface of the first chamber in the airfoil and the second end of the pin configured to be operably coupled with an inner floor surface of the tip floor such that the pin increases a structural load support level of the tip floor relative to the first end of the pin not being operably coupled with the first surface of the first chamber and the second end of the pin not being operably coupled with the inner floor surface of the tip floor; and a cooling conduit configured to be placed inside the pin through which coolant flows, the cooling conduit elongated along and extending around a conduit axis, the cooling conduit fluidly coupled with one or more conduit channels disposed between the first end of the pin and the second end of the pin, wherein the one or more conduit channels are configured to direct the coolant out of the cooling conduit or direct the coolant into the cooling conduit.

2. The cooling assembly of claim 1, further comprising a second chamber of the airfoil fluidly coupled with the cooling conduit, wherein the cooling conduit is configured to direct the coolant from the second chamber to the first chamber.

3. The cooling assembly of claim 2, wherein the cooling conduit is configured to direct the coolant from the second chamber in a first direction, and wherein the one or more conduit channels are configured to direct the coolant out of the cooling conduit or direct the coolant into the cooling conduit in a different, second direction.

4. The cooling assembly of claim 2, further comprising one or more interior channels, wherein the first chamber is fluidly coupled with the second chamber by the one or more interior channels.

5. The cooling assembly of claim 1, further comprising a pressure side inner surface of the airfoil and a suction side inner surface of the airfoil, wherein the first chamber is configured to extend between the pressure side inner surface of the airfoil and the suction side inner surface of the airfoil inside the tip end of the airfoil.

6. The cooling assembly of claim 5, wherein the one or more conduit channels are configured to direct the coolant out of the cooling conduit to the pressure side inner surface of the airfoil or to the suction side inner surface of the airfoil.

7. The cooling assembly of claim 1, wherein the first end of the pin is configured to be integrated with the first surface of the first chamber, and wherein the second end of the pin is configured to be integrated with the inner floor surface of the tip floor.

8. The cooling assembly of claim 1, wherein the cooling conduit is configured to direct the coolant to the inner floor surface of the tip floor.

9. The cooling assembly of claim 1, wherein the pin axis is configured to extend in a first direction and the conduit axis is configured to extend in a different, second direction.

10. The cooling assembly of claim 1, further comprising plural turbulators disposed inside the first chamber, wherein the plural turbulators are configured to direct the coolant around the plural turbulators inside the first chamber.

11. A cooling assembly comprising:

a pin disposed inside a first chamber of an airfoil that extends from a hub end to a tip end along a radial length of the airfoil, the first chamber of the airfoil disposed inside the tip end of the airfoil, the tip end of the airfoil comprising a tip floor, the pin extending from a first end to a second end along a pin axis, the first end of the pin configured to be operably coupled with a first surface of the first chamber and the second end of the pin configured to be operably coupled with an inner floor surface of the tip floor such that the pin increases a structural load support level of the tip floor relative to the first end of the pin not being operably coupled with the first surface of the first chamber and the second end of the pin not being operably coupled with the inner floor surface of the tip floor;

a cooling conduit configured to be placed inside the pin through which coolant flows, the cooling conduit elongated along and extending around a conduit axis, the cooling conduit fluidly coupled with one or more conduit channels disposed between the first end of the pin and the second end of the pin; and a second chamber disposed inside the airfoil, the second chamber fluidly coupled with the cooling conduit.

12. The cooling assembly of claim 11, wherein the cooling conduit is configured to direct the coolant from the second chamber in a first direction, and wherein the one or more conduit channels are configured to direct the coolant out of the cooling conduit or direct the coolant into the cooling conduit in a different, second direction.

13. The cooling assembly of claim 11, further comprising a pressure side inner surface of the airfoil and a suction side inner surface of the airfoil, wherein the first chamber is configured to extend between the pressure side inner surface of the airfoil and the suction side inner surface of the airfoil inside the tip end of the airfoil.

14. The cooling assembly of claim 11, wherein the first end of the pin is configured to be integrated with the first surface of the first chamber, and wherein the second end of the pin is configured to be integrated with the inner floor surface of the tip floor.

15. The cooling assembly of claim 11, wherein the cooling conduit is configured to direct the coolant to the inner floor surface of the tip floor.

16. The cooling assembly of claim 11, wherein the pin axis is configured to extend in a first direction and the conduit axis is configured to extend in a different, second direction.

17. The cooling assembly of claim 11, further comprising one or more interior channels, wherein the first chamber is fluidly coupled with the second chamber by the one or more interior channels.

18. The cooling assembly of claim 11, further comprising plural turbulators disposed inside the first chamber, wherein the plural turbulators are configured to direct the coolant around the plural turbulators inside the first chamber.

19. A cooling assembly comprising:

plural pins disposed inside a first chamber of a component of a turbine assembly that extends from a hub end to a tip end along a radial length, the tip end comprising a tip floor, each pin extending from a first end to a second end along a pin axis of each pin, the first end of each pin configured to be operably coupled with a first surface of the first chamber and the second end of each pin configured to be operably coupled with an inner floor surface of the tip floor such that the pins increase a structural load support level of the tip floor relative to the first ends of the pins not being operably coupled with the first surface of the first chamber and the second ends of the pins not being operably coupled with the inner floor surface of the tip floor; and a plurality of cooling conduits, one cooling conduit of the plurality of cooling conduits configured to be placed inside each pin through which coolant flows, each cooling conduit elongated and extending around a conduit axis, the cooling conduits fluidly coupled with one or more conduit channels disposed between the first end of each pin and the second end of each pin, wherein the one or more conduit channels are configured to direct the coolant out of a respective cooling conduit of the plurality of cooling conduits or direct the coolant into a respective cooling conduit of the plurality of cooling conduits.

20. The cooling assembly of claim 19, further comprising a second chamber fluidly coupled with each cooling conduit, wherein each cooling conduit is configured to direct the coolant from the second chamber to the first chamber.

* * * * *